US005695902A

United States Patent [19]

Mikuriya et al.

[11] Patent Number: 5,695,902

[45] Date of Patent: Dec. 9, 1997

[54] TONER FOR DEVELOPING ELECTROSTATIC IMAGE, IMAGE FORMING METHOD AND PROCESS-CARTRIDGE

[75] Inventors: Yushi Mikuriya, Kawasaki; Yuichi Mizoh, Toride; Tadashi Doujo, Kawasaki, all of Japan

[73] Assignee: Canon Kabushiki Kaisha, Tokyo, Japan

[21] Appl. No.: 749,635

[22] Filed: Nov. 15, 1996

[30] Foreign Application Priority Data

Nov. 20, 1995 [JP] Japan ..... 7-323563

[51] Int. Cl.[6] ..... G03G 13/22; G03G 9/097

[52] U.S. Cl. ..... 430/110; 430/106.6; 430/110; 430/111; 430/126; 399/265

[58] Field of Search ..... 430/106.6, 110, 430/111, 126

[56] References Cited

U.S. PATENT DOCUMENTS

| | | | |
|---|---|---|---|
| 5,139,914 | 8/1992 | Tomiyama et al. | 430/106.6 |
| 5,270,143 | 12/1993 | Tomiyama et al. | 430/126 |
| 5,270,770 | 12/1993 | Kukimoto et al. | 430/106.6 |
| 5,307,122 | 4/1994 | Ohno et al. | 430/111 |
| 5,364,720 | 11/1994 | Nakazawa et al. | 430/110 |
| 5,424,810 | 6/1995 | Tomiyama et al. | 430/106.6 |
| 5,534,981 | 7/1996 | Ohno et al. | 430/109 |
| 5,618,647 | 4/1997 | Kukimoto et al. | 430/106.6 |

FOREIGN PATENT DOCUMENTS

| | | |
|---|---|---|
| 0438245 | 7/1991 | European Pat. Off. . |
| 0650097 | 4/1995 | European Pat. Off. . |
| 0681224 | 11/1995 | European Pat. Off. . |
| 2177224 | 1/1987 | United Kingdom . |

OTHER PUBLICATIONS

Patent Abstracts of Japan, vol. 18, No. 405 (P-1778) Jul. 1994 for JPP 61-18692, Apr. 1994.

Patent Abstracts of Japan, vol. II, No. 256 (P-607) Aug. 1987 for JPP 62-61065, Mar. 1987.

*Primary Examiner*—Roland Martin

*Attorney, Agent, or Firm*—Fitzpatrick, Cella, Harper & Scinto

[57] ABSTRACT

A toner for developing an electrostatic image is formed as a mixture of toner particles containing at least a binder resin and a colorant, and inorganic fine powder. The inorganic fine powder includes: (A) inorganic fine powder (A) treated at least with silicone oil, and (B) inorganic fine powder (B) comprising a composite metal oxide including at least Si as a constituent element and having a weight-average particle size of 0.3–5 μm. Because of the inclusion of the two types of inorganic fine powders (A) and (B), the toner is stably provided with a high flowability and a high triboelectric charge under various environmental conditions including low-humidity to high-humidity conditions. The toner is suitably used in an image forming system including a contact-charging means, a contact-transfer means and a film (or surf)-fixing system.

59 Claims, 5 Drawing Sheets

TONER FOR DEVELOPING ELECTROSTATIC IMAGE, IMAGE FORMING METHOD AND PROCESS-CARTRIDGE

FIELD OF THE INVENTION AND RELATED ART

The present invention relates to a toner for developing electrostatic images in image forming methods, such as electrophotography and electrostatic printing, and also an image forming method and a process-cartridge using the toner.

Hitherto, a large number of electrophotographic processes have been known, as disclosed in U.S. Pat. Nos. 2,297,691; 3,666,363; 4,071,361 and others. In these processes, an electrostatic latent image is formed on a photosensitive member comprising a photoconductive material by various means, then the latent image is developed and visualized with a toner, and the resultant toner image is, after transferred onto a transfer(-receiving) material such as paper etc., as desired, fixed by heating, pressing, or heating and pressing, or with solvent vapor to obtain a toner image.

Accompanying development of digital copying machines and reduction in size of toner particles in recent years, it has been desired to develop copying machines having multiplicity of functions, capable of providing high-quality copy images, and having a shorter first copy time through an improvement in a fixing system in view of energy saving as measures against environmental problems.

However, the development of a toner of a smaller particle size for improving resolution and clarity of images and reduction of a first copy time results in new problems accompanying it.

More specifically, a smaller toner particle size leads to an increase in surface area of toner particles per unit weight, whereby the toner chargeability is more liable to be affected by the environment. Particularly, in case where such toner particles are left standing in a high-temperature and high-humidity environment for a long period, the toner particles are susceptible to moisture, thus being liable to result in a lowering in image density after the standing.

A recent digital copying machine is even required to provide a combination of a character image which is clear and a photographic image which faithfully reproduces the density gradation of the original. As a general tendency in a copy of a photographic image with characters, an increase in line image density for providing clearer characters not only impairs the density gradation characteristic of the photographic image but results in remarkable roughness in the halftone portion. On the other hand, in the case of improving the density gradation characteristic of the photographic image, the line density of the character image is lowered and the clarity of the character image is impaired.

In recent years, it has become possible to provide an image with improved density gradation to some extent by reading the image density at respective portions of an image and digitally converting the read density data, but a further improvement is desired at present.

Such further improvements largely depend on improvements in developing characteristics of a developer. Image densities do not usually satisfy a linear relationship with developing potentials (differences between potentials of a photosensitive member and a developer-carrying member) but show a tendency of projecting downwardly at low developing potentials and projecting upwardly at higher developing potentials as indicated by a solid curve in FIG. 2. Accordingly, in a halftone region, the image density varies greatly corresponding to a slight change in developing potential. As a result, it is difficult to provide a good density gradation characteristic. In FIG. 2, a solid curve represents a case wherein a maximum image density is set to be larger than 1.4, and a dashed curve represents a case wherein a better density gradation characteristic is intended.

In order to obtain a clear copy of a line image, it is practically sufficient to have a maximum density on the order of 1.30 at a solid image part not readily affected by an edge effect as the contrast of a line image is generally enhanced by the edge effect.

In a photographic image, however, an original image per se has a very large maximum density of 1.90–2.00 while the impression thereof is largely affected by a surface gloss. Accordingly, in a copy of such a photographic image having a generally large area and not causing a density increase owing to the edge effect, it is necessary to retain a maximum image density of about 1.4–1.5 at a solid image part even if the surface gloss is suppressed. Accordingly, in copying a photographic image with characters, it is very important to satisfy a linear relationship between the developing potential and the image density and retain a maximum image density of 1.4–1.5.

Further, as a digital copying machine generally adopts a reversal development scheme, the toner is attached for developing to no-charge portions or portions of an identical polarity of a photosensitive member and is retained by the photosensitive member surface with charges generated by electrostatic induction caused by the toner.

Accordingly, in order to stably convey the toner by the photosensitive member, it is necessary to provide the toner with an increased charge for causing the electrostatic induction.

Further, at the time of transfer, a transfer-receiving material (i.e., paper, etc.) is charged to a polarity opposite to that of the photosensitive member. Accordingly, if the transfer current is increased, it is liable to cause a winding, i.e., electrical attachment, of the transfer-receiving material, about the photosensitive member, or the re-transfer of the transferred toner image back to the photosensitive member.

Accordingly, the transfer current is required to be lowered and, in order to retain a transfer efficiency at a weak electric field, it becomes necessary to provide the toner with an increased charge while increase the releasability between the toner and the photosensitive member.

In a developing operation using a conventional toner, as the shortage of charge causes a lowering in developing efficiency to result in a lower image density, a selection development phenomenon that a toner fraction of a higher charge being preferentially consumed, is caused. Accordingly, a toner fraction of a relatively low charge preferentially remains on the developing sleeve, and the particle size of the toner remaining in the developing vessel is enlarged to result in inferior image quality during continuous image formation.

At the time of transfer, an insufficient toner charge results in a lower transfer efficiency to cause a lower image density, and it becomes difficult to constrain the toner image under the electric field, so that the toner image is liable to be scattered during transfer to result in a lower image quality.

On the other hand, the corona discharge means has been conventionally used as charging means in electrophotography. However, the corona discharge means cause a large amount of ozone, which in turn requires a filter equipment, so that the entire size and the running cost of the image forming apparatus are liable to be increased.

In order to solve the above-mentioned problems, there has been developed a charging system wherein a charging member of a roller or a blade is abutted to the photosensitive member surface to form a narrow space in proximity to the abutting portion, where discharge according to the Paschen's law is caused, thereby suppressing the ozone generation. A roller charging scheme using a charging roller as a charging member has been particularly preferably used because of a charging stability.

For example, JP-A 63-149669 and JP-A 2-123358 have disclosed an image forming system using a contact charging scheme and a contact transfer scheme, wherein an electroconductive elastic roller is abutted against an electrostatic image-bearing member (photosensitive member) to uniformly charge the electrostatic image-bearing member while applying a voltage to the electroconductive roller, then a toner image is formed on the image-bearing member through exposure and development steps, and another electroconductive roller is pressed against the image-bearing member while passing a transfer-receiving member therebetween to transfer the toner image onto the transfer-receiving material, followed by a fixing step to obtain a copy image.

In such a contact charging apparatus, however, the essential charging mechanism thereof relies on a discharge from the charging member to the photosensitive member, the voltage for the charging is required to be higher than a resulting-surface potential on the photosensitive member. Further, in case where AC-charging is performed in order to realize uniform charging, there have arisen new problems of AC-charging noise, i.e., a noise accompanying an oscillation between the charging member and the photosensitive member caused by an electric field of the AC voltage, and a deterioration of the photosensitive member surface due to the discharge, which in turn causes the melt sticking or filming of the toner or toner component onto the photosensitive member surface.

In the roller transfer scheme without using the corona discharge, the transfer member is abutted against the photosensitive member via a transfer-receiving material, so that there are liable to result in a filming due to rubbing of toner during blank rotation before and after supply of the transfer-receiving material and a local transfer failure called "transfer dropout" caused by pressing of the toner image on the photosensitive member at the time of transfer of the toner image onto the transfer-receiving member.

In order to solve the above problem, JP-A 3-121462 has proposed an image forming apparatus using a developer containing hydrophobic inorganic fine powder treated with silicone oil. However, a sufficient improvement has not been attained for a thick transfer-receiving paper having a basis weight exceeding 100 g/m$^2$, such as a post card and Kent paper, and for OHP sheets. Further, toner properties suitably used in connection with a heater-less drum and for accomplishing a shorter first copying time as required in current copying machines, are not satisfied by the developer.

As the above-mentioned charging members contact the photosensitive member, the transfer residual toner and the portion of toner having slipped by the cleaner are liable to attach to the transfer member and the charging member and, if a large amount thereof is accumulated, it becomes difficult to effect uniform charging and uniform transfer, thus being liable to result in streaks or irregularities in halftone images.

The residual toner remaining on the photosensitive member without being transferred onto the transfer-receiving material is removed from the photosensitive member in the cleaning step. The cleaning step has been conventionally effected by using a cleaning blade, a cleaning fur brush, a cleaning roller, etc. In any of cleaning means, the transfer residual toner is dynamically scraped off or dammed up to be recovered into a waste toner container. As such a member is pressed against the photosensitive member surface, the photosensitive member is liable to be worn or damaged to cause image defects, fixing (or melt sticking) of toner onto the photosensitive member (drum) surface, or attachment (filming) of an external additive, such as isolated silica, onto the drum surface.

Further, in recent years, a fixing system (a surf-fixation system) using a film having a good thermal conductivity is becoming to be used instead of a roller fixation system as a fixing means suitable for an on-demand use wherein power is supplied to the fixing device not when the copying machine is not used but only when the machine is on service, or a copying system allowing a quick start requiring no wait time after putting a power supply to the copying machine.

In the surf-fixation system, because of a small heat capacity of the film, the temperature of a portion of conveyed transfer paper entering the film is rather low, so that the toner on the transfer paper has not been substantially melted before it contacts the film. In this instance, the toner image on the transfer paper can be disturbed due to a slight air flow caused at the contacting place between the transfer paper and the film or an electrostatic force exerted from the film, thus resulting in an image defect called "fixation scattering". This is a phenomenon to be more pronounced in a higher copying speed system. In order to avoid the phenomenon, the transfer has to be sufficiently completed in the transfer step. This is because, if a toner of a high charge is used for development on a photosensitive member and the resultant toner image is effectively transferred, the toner can be deposited in a high density on the transfer paper, thus being able to prevent the fixation scattering.

In order to obviate the above-mentioned difficulties, it is important to provide as much a charge to the toner as uniformly as possible and also improve the releasability between the toner and the photosensitive member. Further, in view of the structure and function currently required of a copying machine, it is important to prevent the lowering in toner charge and the lowering in toner flowability as possibly expected in a high temperature-high humidity environment and retain stable image qualities for a long period.

As methods of stabilizing the toner charge, Japanese Laid-Open Patent Application (JP-A) 58-66951, JP-A 59-168458 to JP-A 59-168460 and JP-A 59-170847 have proposed the use of electroconductive zinc oxide and tin oxide. JP-A 60-32060 has proposed a method wherein two kinds of inorganic fine powder are used to remove paper dust and ozone adduct formed on or attached to the surface of a photosensitive member. JP-A 2-110475 has proposed a method wherein two kinds of inorganic fine powder are used in combination with a toner comprising styrene-acrylic resin crosslinked with a metal to remove paper dust and ozone adduct formed on or attached to the surface of a photosensitive member, and alleviate toner scattering, image flow and image density decrease in a high temperature-high humidity environment. According to these methods, however, it is difficult to shorten the first copy time as required in current copying machines while using a toner of a small particle size, because it is liable to result in a lowering in image density.

JP-A 61-236559 and JP-A 63-2073 have disclosed methods wherein cerium oxide particles are used to improve the toner chargeability. According to this method, the toner chargeability can be surely increased but, when an organic photosensitive member is used, the surface layer of the photosensitive member can be gradually abraded due to an abrasive effect of the cerium oxide, thus resulting in inferior copy images.

Accordingly, accompanying the development of a smaller particle size toner, a toner capable of being uniformly charged and retaining its chargeability even if the toner is left standing for a long time in a high temperature-high humidity environment, is still desired.

A toner is caused to have a charge distribution similarly as a particle size distribution. In the case of a mono-component toner, the charge distribution is affected by states of dispersion of toner components, such as a magnetic material or a colorant, in toner particles, and toner particle size distribution. In case where the toner components are evenly dispersed in toner particles, the toner charge distribution is principally affected by the toner particle size distribution.

Toner particles of a smaller particle size generally have a larger charge per unit weight, and toner particles of a larger particle size generally have a smaller charge per unit weight. A toner having a larger charge tends to have a broader distribution thereof, and a toner having a smaller charge tends to have a narrower distribution thereof.

In order to provide a stable charge, there has been proposed a method of attaching electroconductive powder onto toner particles as mentioned above. According to this method, however, it is difficult to satisfy a sufficiently larger maximum image density and a sufficient suppression of image quality deterioration during continuous image formation in combination. This is presumably for the following reasons.

According to the method of attaching electroconductive powder onto toner particles, a large amount of electroconductive powder is attached onto toner particles of a smaller particle size, i.e., toner particles having a larger charge. As a result, fog on white background can be reduced but, on the other hand, the toner particles of a smaller particle size are liable to be preferentially consumed for development (selection development) because of a reduced charge. When the toner particles are fixed, the area covered therewith of a fixation sheet becomes smaller than the coverage with toner particles of a large particle size, thus resulting in a lower maximum image density. Further, as the toner particles of a smaller particle size is selectively used for development, the particle size of toner remaining in the developing device is shifted toward a larger side, thus causing a lowering in image quality compared with that of initial images.

In contrast with the method of lowering the toner charge, the method of causing triboelectric charging between a toner and a metal oxide in the developing device is surely effective for increasing and uniformizing the toner charge. However, because of the requirement of a shorter first copying time in the image forming apparatus, it is impossible to sufficiently provide an increased toner charge in the developing device by utilizing a wait time. This is particularly true in a high temperature-high humidity environment. This is because, as the toner particle size is reduced, the flowability of the toner is lowered and this is more pronounced in a high temperature-high humidity environment because of moisture absorption and a lowering in chargeability. In a conventional copying machine using a hot roller fixation system, during a period until a first copy starting within which the fixing roller is heated, the toner may be stirred within the developing device to acquire a certain level of flowability and a certain level of triboelectric charge. However, along with an improvement in fixing device, the heating-up time for the device has been shortened. Further, in the surf-fixation system wherein transfer paper is pressed against a heating member via a film to fix a developed toner image onto the transfer paper, substantially no wait time is involved. In combination of such a fixing system, the above-mentioned stirring cannot be effected, so that the toner flowability and the toner charge cannot be increased sufficiently, thus being liable to result in images having a low image density and accompanied with fog. Further, it is also liable that the toner image is not sufficiently fixed onto the transfer paper and the toner image scattering occurs at the time when the toner image enters the fixing device, as described above.

JP-A 5-333590 powder has proposed a toner containing composite metal oxide. When blended with a toner, metal oxide powder having a certain size relative to that of toner particles is once attached to toner particles and separated therefrom under a shearing force exerted in the developing device, so that the number of contact with the toner particles is increased to provide an increased toner charge. However, the composite metal oxide disclosed above is liable to cause a lowering in toner flowability. As a result, when the toner is used especially in an image forming apparatus including the surf-fixation system, there is liable to result in images of lower quality in a high temperature-high humidity environment.

SUMMARY OF THE INVENTION

A generic object of the present invention is to provide a toner for developing electrostatic images which has solved the above-mentioned problems.

Another object of the present invention is to provide a toner for developing electrostatic images capable of providing copy images having a high image density from at an initial stage to after standing for a long time even in a high temperature-high humidity environment.

Another object of the present invention is to provide a toner for developing electrostatic images which can be uniformly applied on a developer-carrying member and of which toner particles can be triboelectrically charged efficiently and uniformly.

Another object of the present invention is to provide a toner for developing electrostatic images capable of stably providing images which have a stable density from the initial stage and are free from fog or irregularity even in a low humidity environment or a high humidity environment and uniform in density for a long period.

Still another object of the present invention is to provide a toner for developing electrostatic images, having a high flowability and capable of providing images which are high in resolution and sharpness and faithful to an original.

A further object of the present invention is to provide a toner for developing electrostatic images, capable of providing halftone images and solid images which are uniform and free from roughening.

A further object of the present invention is to provide a toner for developing electrostatic images, showing a high transfer efficiency and capable of providing images free from transfer dropout or image lack even in an image forming method using contact transfer means.

Another object of the present invention is to provide a toner for developing electrostatic images, capable of preventing the attachment, melt-sticking or filming of toner onto a photosensitive member even in a long period of continuous image formation using a charging member for contact charging or contact transfer.

A further object of the present invention is to provide a toner for developing electrostatic images, less liable to cause toner scattering on a recording material or transfer-receiving material at the time of fixation even in a heat-fixation system wherein the transfer-receiving material is intimately pressed via a film against a heating member to heat-fix a developed toner image onto the transfer-receiving material.

A still further object of the present invention is to provide a toner for developing electrostatic images, capable of stably providing images of high image quality and high image density even in image formation on a large number of sheets in various environments.

Another object of the present invention is to provide an image forming method using a toner as described above.

A further object of the present invention is to provide a process-cartridge containing a toner as described above.

According to the present invention, there is provided a toner for developing an electrostatic image comprising: toner particles containing at least a binder resin and a colorant, and inorganic fine powder; wherein the inorganic fine powder includes:

(A) inorganic fine powder (A) treated at least with silicone oil, and (B) inorganic fine powder (B) comprising a composite metal oxide including at least Si as a constituent element and having a weight-average particle size of 0.3–5 μm.

According to another aspect of the present invention, there is provided an image forming method, comprising:

charging an electrostatic image-bearing member by primary charging means;

forming an electrostatic image on the charged electrostatic image-bearing member by exposure to light;

developing the electrostatic image with the above-mentioned toner held by developing means to form a toner image on the electrostatic image-bearing member;

transferring the toner image on the electrostatic image-bearing member by transfer means onto a transfer-receiving material via or without via an intermediate transfer member, heat-fixing the toner image on the transfer-receiving material by heat-fixing means.

According to a further aspect of the present invention, there is provided a process-cartridge, comprising: an electrostatic image-bearing member, and developing means for developing an electrostatic image formed on the electrostatic image-bearing member with the above-mentioned toner contained therein; the electrostatic image-bearing member and the developing means being integrally assembled to form a cartridge, which is detachably mountable to a main assembly of the image forming apparatus. The process-cartridge may be provided with a contact-charging member abutted against the electrostatic image-bearing member for charging the electrostatic image-bearing member.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
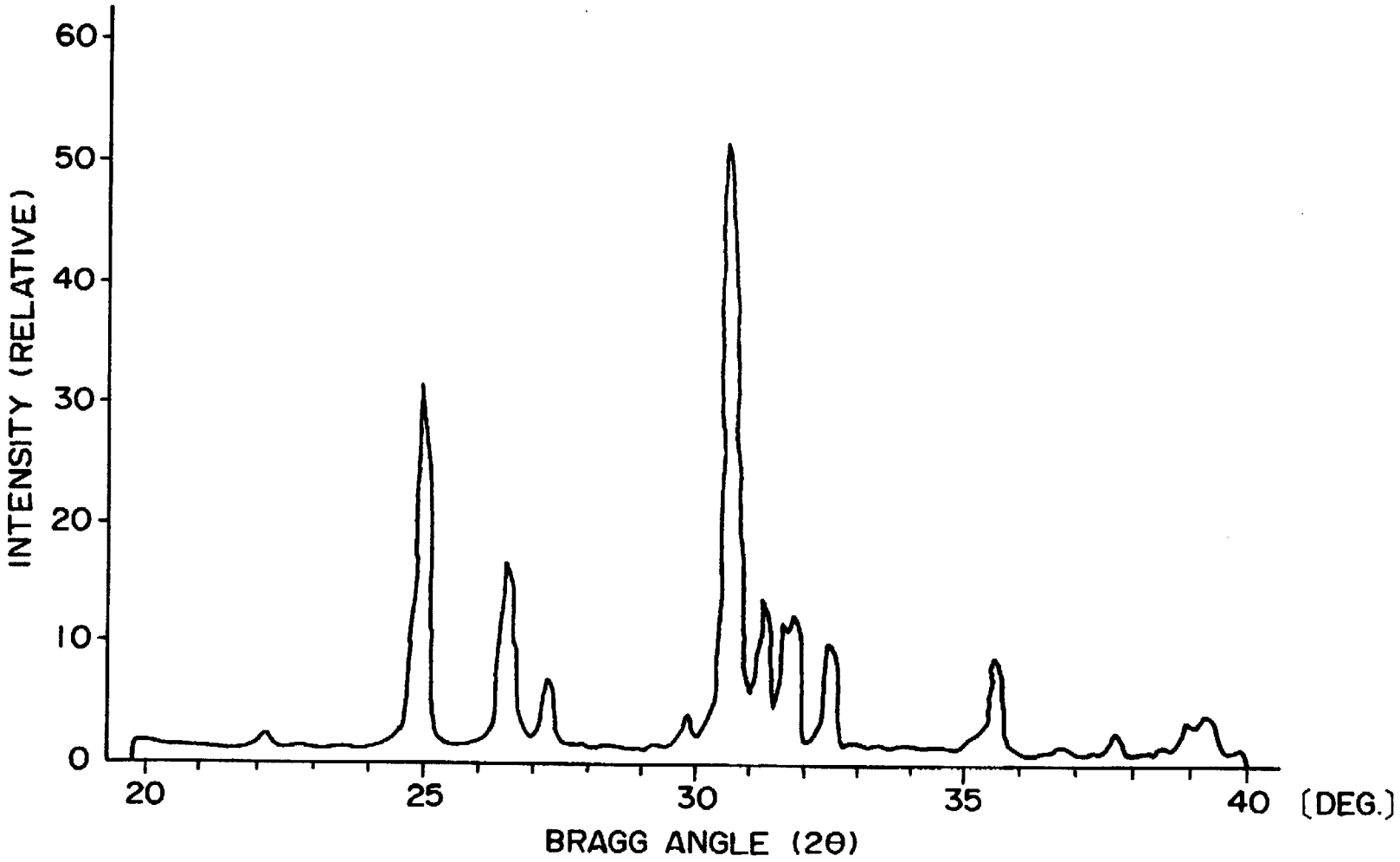
FIG. 1 shows an X-ray diffraction pattern of inorganic fine powder comprising strontium silicate.
Figure 2:
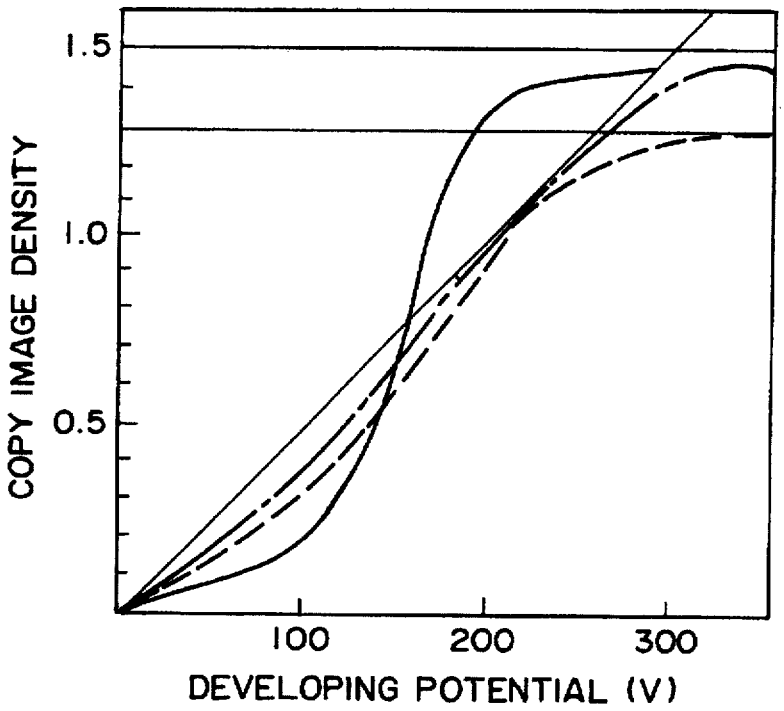
FIG. 2 is a graph showing relationship between copy image density and developing potential, wherein a solid curve represents a case wherein the maximum image density is set to 1.4 or higher, a broken line represents a case wherein a condition is set to provide a good density gradation, and an alternate long and short dash line represents a case wherein a toner having an improved developing characteristic is used.

As a result of our extensive study, the following knowledge has been obtained.

(a) A flowability-improving agent (flowability improver) not only provides an improvement in flowability of a toner but also improves developing performances. This is presumably because a generally known flowability improver (e.g., fluorinated compound, $SiO_2$, surface-treated $SiO_2$, etc.) has a polarity, so that the flowability improver affects charging characteristics of the toner. From a viewpoint of image density, a large addition amount of the flowability improver is generally advantageous. However, if an excessive amount of the flowability improver is used, a state of the flowability improver attached to the toner particle surface is liable to be changed and accordingly, it is difficult to retain uniform triboelectrification among the toner particles, thus being liable to result in fog.

(b) It is possible to improve a flowability of composite metal oxide particles per se by blending composite metal oxide particles with a flowability improver in advance of blending with toner particles. In addition, by using the composite metal oxide particles, a lowering in flowability of a toner in a high temperature-high humidity environment can be prevented. However, in this case, the composite metal oxide particles are lowered in its charge-imparting ability, per se, as an intended function, resulting from triboelectric charging with the toner particle, so that difficulties such as lowering in image density and occurrence of fog are liable to arise. This is presumably because charge transfer occurs between the flowability improver and the composite metal oxide particles in addition to triboelectric charging originally effected between the toner particles and the composite metal oxide particles, so that a charge of the entire toner is reduced compared with the case of not adding the composite metal oxide particles. Consequently, the toner is liable to be lowered in developing performances, and result in a lowering in image density and fog.

As a result of further study for obtaining a toner having a higher triboelectric chargeability and retaining a high transferability without impairing flowability, thus being capable of continually providing high-quality images, we have had the following knowledge.

By externally adding inorganic fin powder (A) treated at least with silicone oil to the toner particles, it becomes possible to prevent transfer dropout and filming for a long period and also prevent the lowering in image density due to a lowering in chargeability in a high-humidity environment.

In the method of providing an increased charge by contact between toner particles and composite metal oxide particles (i.e., a method of not attaching composite metal oxide particles compltely onto toner particles but contacting the toner particles and the composite metal oxide particles with each other for triboelectrification in a developing device), it is possible to improve the flowability, initial charging rate and saturation charge of a toner by adding inorganic fine powder (B) containing Si as a constituent element and having a specific particle size.

By adding the above-mentioned two types of inorganic fine powder (A) and (B) externally to the toner particles, it is possible to provide a toner showing high flowability, chargeability and transferability and capable of providing high-quality images in various environments.

More specifically, by incorporating Si element in composite metal oxide, the resultant toner is provided with a better flowability than in the case of incorporating another element presumably because of a better flowability-improving effect of Si element as is understood from the fact that silica is generally used as a flowability-improving agent. The inorganic fine powder (B) comprising a composite metal oxide containing Si as a constituent element and having a specific particle size has a high charge-imparting ability in triboelectrification with toner particles to provide a toner having a large triboelectric chargeability. As a result, even in a high temperature-high humidity environment, it is possible to provide a sufficient charge for giving a satisfactory developing performance even by a small number of contact with toner particles while avoiding the lowering in toner flowability.

Further, by using the inorganic fine powder (A) surface-treated with at least silicone oil in combination with the inorganic fine powder (B), it is possible to obviate the lowering in toner charge and resultant image density due to moisture absorption in a high humidity environment. Further, even in case of copying for a long period in various copying machines, it is possible to continually form high-quality images without causing filming or transfer dropout.

As described above, for providing a sufficient developing performance without causing filming or transfer dropout when used in various copying machines (inclusive of those adopting the contact charging scheme and the contact transfer scheme), the toner for developing electrostatic images according to the present invention contains in combination the inorganic fine powder (A) surface-treated at least with silicone oil and the inorganic fine powder (B) comprising a composite metal oxide containing Si element and having a specific particle size to provide a high charge-imparting ability to toner particles. This is also important for preventing "fixation scattering" liable to occur in the surf-fixation system and providing a toner having a sufficient flowability and a developing performance even in a high temperature-high humidity environment.

The toner composition suitable for accomplishing the objects of the present invention will now be described.

The silicone oil for surface treating the inorganic fine powder may preferably comprise one represented by the following formula:

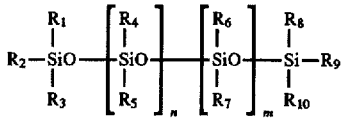

wherein $R_1$–$R_{10}$ independently denote hydrogen, hydroxyl, alkyl, halogen, phenyl, phenyl having a substituent, aliphatic acid group, polyoxyalkylene or perfluoroalkyl, and m and n denote integers.

The silicone oil may preferably have a viscosity at 25° C. of 5–2000 $mm^2$/sec. Silicone oil having too low a molecular weight and a low viscosity is liable to be volatile. Silicone oil having too high a molecular weight and a high viscosity causes a difficulty in the surface treatment therewith. Preferred examples of the silicone oil may include: methylsilicone oil, dimethylsilocone oil, phenylmethylsilicone oil, chlorophenylmethylsilicone oil, alkyl-modified silicone oil, and polyoxyalkylmodified silicone and.

It is also possible to use a silicone oil having a nitrogen-containing side chain. Such silicone oil may have a partial structure represented by the following formulae:

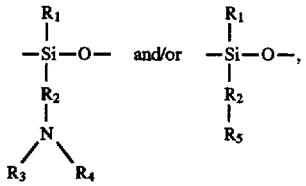

wherein $R_1$ denotes hydrogen, alkyl, aryl or alkoxy; $R_2$ denotes alkylene or phenylene; $R_3$ and $R_4$ denote hydrogen, alkyl or aryl; and $R_5$ denotes a nitrogen-containing heterocyclic group.

The above-mentioned alkyl, aryl, alkylene or phenylene can comprise a nitrogen-containing organo group or have a substituent, such as halogen.

The silicone oil may preferably have a charging polarity identical to that of the toner particle so as to provide an improved toner chargeability.

The inorganic fine powder may be treated with a known manner, e.g., by direct blending of the inorganic fine powders and silicone oil by a blender, such as a Henschel mixer, or by spraying silicone oil onto the inorganic fine powder. Alternatively, it is also possible to first dissolve or disperse silicone oil in an appropriate solvent, and then blending it with the inorganic fine powder, followed by removal of the solvent.

The silicone oil may preferably be used in an amount of 1.5–60 wt. parts, more preferably 3.5–'wt. parts, per 100 wt. parts of inorganic fine powder to be treated. The amount within the range of 1.5–60 wt. parts allows a uniform treatment with the silicone oil to suitably prevent the filming and dropout, prevent the lowering in toner chargeability due to moisture absorption in a high humidity environment and prevent the lowering in image density during a continuous image formation. In the case of using the surf-fixation system, it is possible to prevent image defects, such as fixation scattering. It is also possible to prevent the lowering in toner flowability and the occurrence of fog.

The inorganic fine powder (A) may preferably have a specific surface area of 50–400 $m^2$/g, more preferably 80–390 $m^2$/g. The value in the range of 50–400 $m^2$/g allows the provision of good chargeability and transferability to toner particles and prevents the lowering in toner charge and image quality deterioration during a long period of continuous image formation.

The inorganic fine powder (A) may preferably have a hydrophobicity of at least 95%, more preferably at least 97%. A hydrophobicity of at least 95% provides an improved moisture resistance and prevents the image density lowering in a high humidity environment.

It is also preferred to treat the inorganic fine powder (A) with a silane coupling agent prior to or simultaneously with the treatment with silicone oil.

The silane coupling agent may be used in an amount of 1–40 wt. parts, preferably 2–35 wt. parts, per 100 wt. parts of the inorganic fine powder before treatment in the range of 1–40 wt. parts provides an improved moisture resistance and is little liable to cause agglomeration.

The silane coupling agent may be those represented by the following general formula:

$$R_mSiY_n,$$

wherein R denotes alkoxy group or chlorine atom; m denotes an integer of 1–3; Y denotes a hydrocarbon group, such as alkyl, vinyl, glycidyl, or methacryl; and n is an integer of 3–1.

Examples of the silane coupling agent may include: dimethyldichlorosilane, trimethylchlorosilane, alkyldimethylchlorosilane, hexamethyldisilazane, allylphenyldichlorosilane, benzyldimethylchlorosilane, vinyltriethoxysilane, γ-methacryloxypropyltrimethoxysilane, vinyltriacetoxysilane, divinylchlorosilane, and dimethylvinylchlorosilane.

The inorganic fine powder may be treated with a silane coupling agent in a known process such as a dry process wherein the inorganic fine powder placed in a cloudy state under stirring is reacted with vaporized silane coupling agent; or in a wet process wherein the inorganic fine powder is dispersed within a solvent and a silane coupling agent is added dropwise thereto to cause the reaction.

The inorganic fine powder as the base material for treatment with silicone oil may comprise oxide, composite oxide, metal oxide, metal, carbon, carbon compound, fullerene, boron compound, carbide, nitride, ceramic, or halcogenide. Metal oxides are preferred, among which silica, alumina and titania are especially preferred. It is particularly preferred to use silica because it provides a stably high saturation charge.

The silica used as the inorganic fine powder (A) may be those obtained through the dry process according to vapor phase oxidation of silicone halide (such as pyrolysis within oxygen-hydrogen flame), and the wet process including decomposition of sodium silicate, alkali earth metal silicates or other silicates with acid, ammonium, salt or alkali-salts. It is particularly preferred to use amorphous silica.

The titania used as the inorganic fine powder (A) may be those obtained through the sulfuric acid process, the chlorine process, or low-temperature oxidation (pyrolysis or hydrolysis) of, e.g., titanium alkoxide, titanium halide, or titanium acetylacetonate. The crystalline system of the titania may be of the anatase-type, rutile-type, a mixture crystal of these, or amorphous.

The alumina used as the inorganic fine powder (A) may be those obtained through the Bayer process, the improved Bayer process, the ethylene chlorohydrin process, the spark discharge in water process, the hydrolysis of organoaluminum compound, the pyrolysis of aluminum alum, and the flame decomposition of aluminum chloride. The alumina may have a crystal system of α, β, γ, δ, ξ, ζ, θ, κ, χ, ρ or a mixture of these or may be amorphous. It is particularly preferred to use alumina of α, δ, γ, θ, mixture crystal or amorphous.

The inorganic fine powder (B) used in the present invention is required to have a weight-average particle size of 0.3–5 μm, preferably 0.5–3 μm, so as to exhibit the function and effect of the present invention.

A weight-average particle size of below 0.3 μm results in a large attachment force onto toner particles, thus failing to realize the good triboelectrification of toner particles and failing to exhibit the effect of the present invention. On the other hand, a weight-average particle size in excess of 5 μm causes insufficient mixing with toner particles and is liable to be remarkably scattered from the sleeve surface, thus soiling the inside of the copying machine. Further, the lowering in image density is also liable to be caused.

A preferred class of the Si-containing composite metal oxides may be represented by the following (compositional) formula:

$$[M]_a[Si]_b[O]_c,$$

wherein, M denotes a metal element or a metal mixture selected from the group consisting of Sr, Mg, Zn, Co, Mn and Ce; a denotes an integer of 1–9; b denotes an integer of 1–9 and c denotes an integer of 3–9. In order to attain better effects of the present invention, the ratio of the metal element (M) and Si may preferably be in the range of a/b=1/9–9.0, more preferably a/b=0.5–3.0.

It is most preferred that the inorganic fine powder (B) is one comprising a composite metal oxide containing Sr in addition to Si in view of the flowability, chargeability and transferability of the resultant toner.

For the reason of better exhibition of the effect of the present invention, it is particularly preferred to use strontium silicate as represented by a compositional formula of $[Sr]_a[Si]_b[O]_c$, including those in the form of $SrSiO_3$, $Sr_3SiO_5$, $Sr_2SiO_4$, $SrSiO_5$ and $Sr_3Si_2O_7$. $SrSiO_3$ is particularly preferred. The inorganic fine powder (B) comprising the composite metal oxide may preferably be formed through the sintering process, followed by mechanical pulverization and pneumatic classification into a desired particle size distribution.

The chargeabilities of the inorganic fine powders (A) and (B) make very important factors in the present invention. It is preferred that the inorganic fine powder (A) has a chargeability to a polarity identical to that of the toner particles and a charge Q1 when measured by triboelectrification with iron powder, satisfying: $|Q|>150$ mC/kg, and the inorganic fine powder (B) has a chargeability to a polarity opposite to that of the toner particles and a charge Q2 when measured by triboelectrification with the toner particles, satisfying: $|Q2|>3.7$ mC/kg, in order to enhance the flowability, chargeability and transferability of the toner.

The charges of the inorganic fine powders (A) and (B) within the above-described ranges provide higher charges of toner particles.

The inorganic fine powder (A) may be used in 0.05–3 wt. parts, preferably 0.1–2.5 wt. parts, per 100 wt. parts of the toner particles. The amount in the range of 0.05–3 wt. parts provides the toner with a high flowability and improvements in various image characteristics, allows uniform charging of toner particles of the sleeve, and prevent the problems, such as image irregularity, fog, image density lowering and filming.

The inorganic fine powder (B) may be used in 0.05–15 wt. parts, preferably 0.1–10 wt. parts, per 100 wt. parts of the toner particles. The amount in the range of 0.05–15 wt. parts allows a high charge of toner even in a high humidity environment and maintenance of a high image density. Further, even in the case of using toner particles of a small particle size in a low humidity environment, a uniform charge can be imparted from the sleeve while preventing coating irregularity on the sleeve and preventing the lowering in image density and the occurrence of fog. Further, the toner particles can effectively receive a triboelectric charge from the sleeve.

The binder resin for constituting the toner particles may for example include vinyl resins, polyester resins and epoxy resins. Among these, vinyl resins and polyester resins are preferred in view of chargeability and fixability.

Examples of vinyl monomers to be used for providing a vinyl resin (copolymer) constituting the binder resin of the present invention may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylenically unsaturated monoolefins, such as ethylene, propylene, butylene, and isobutylene; unsaturated polyenes, such as butadiene; halogenated vinyls, such as vinyl chloride, vinylidene chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacryronitrile, and acrylamide; the esters of the above-mentioned α,β-unsaturated acids and the diesters of the above-mentioned dibasic acids. These vinyl monomers may be used singly or in combination of two or more species.

Among these, a combination of monomers providing styrene-type copolymers and styrene-acrylic (or methacrylic) type copolymers may be particularly preferred.

The binder resin used in the present invention can also be in the form of a crosslinked polymer or copolymer obtained by using a crosslinking monomer, examples of which are enumerated hereinbelow.

Aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate groups for the acrylate groups in the above compounds; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate groups for the acrylate groups in the above compounds; diacrylate compounds connected with a chain including an aromatic group and an ether bond, such as polyoxyethylene(2)-2,2-bis(4-hydroxyphenyl) propanediacrylate, polyoxyethylene(4)-2,2-bis(4-hydroxyphenyl)propanediacrylate, and compounds obtained by substituting methacrylate groups for the acrylate groups in the above compounds; and polyester-type diacrylate compounds, such as one known by a trade name of MANDA (available from Nihon Kayaku K.K.). Polyfunctional crosslinking agents, such as pentaerythritol triacrylate, trimethylolethane triacrylate, trimethylolpropane triacrylate, tetramethylolmethane tetracrylate, oligoester acrylate, and compounds obtained by substituting methacrylate groups for the acrylate groups in the above compounds; triallyl cyanurate and triallyl trimellitate.

These crosslinking agents may preferably be used in a proportion of 0.01–5 wt. parts, particularly 0.03–3 wt. parts, per 100 wt. parts of the other vinyl monomer components.

Among the above-mentioned crosslinking monomers, aromatic divinyl compounds (particularly, divinylbenzene) and diacrylate compounds connected with a chain including an aromatic group and an ether bond may suitably be used for the binder resin in view of fixing characteristic and anti-offset characteristic.

In the present invention, it is possible to mix one or more of homopolymers or copolymers of vinyl monomers as described above, polyester, polyurethane, epoxy resin, polyvinyl butyral, rosin, modified rosin, terpene resin, phenolic resin, aliphatic or alicyclic hydrocarbon resin, aromatic petroleum resin, etc., as desired, with the above-mentioned binder resin.

When two or more species of resins are mixed to provide a binder resin, it is preferred that the two or more species of resins have different molecular weights and are mixed in appropriate proportions.

The binder resin may preferably have a glass transition temperature of 45°–80° C., more preferably 55°–70° C., a number-average molecular weight (Mn) of 2,500–50,000, and a weight-average molecular weight (Mw) of 10,000–1,000,000.

The binder resin comprising the vinyl type polymer or copolymer may be obtained through polymerization, such as bulk polymerization, solution polymerization, suspension polymerization, or emulsion polymerization. When a carboxylic acid monomer and/or an acid anhydride monomer is used, the bulk polymerization or solution polymerization may preferably be used in view of the monomer properties.

An exemplary method thereof is as follows. A vinyl copolymer may be obtained by using an acidic monomer, such as a dicarboxylic acid, a dicarboxylic anhydride or a dicarboxylic acid monoester through bulk polymerization or solution polymerization. In the solution polymerization, a part of the dicarboxylic acid and dicarboxylic acid monoester units may be converted into anhydrides by appropriately controlling the condition for distilling off the solvent. The vinyl copolymer obtained by the bulk polymerization or suspension polymerization may be further converted into anhydride units by heat-treating it. It is also possible to esterify a part of the acid anhydride unit with a compound, such as an alcohol.

Reversely, it is also possible to cause ring-opening of the acid anhydride units of the thus obtained vinyl copolymer to convert a part thereof into dicarboxylic units.

On the other hand, it is also possible to convert a vinyl copolymer obtained by using a dicarboxylic monoester monomer into anhydride by heat-treatment or into dicarboxylic acid by hydrolyzation. The vinyl copolymer obtained through bulk polymerization or solution polymerization may be further dissolved in a polymerizable monomer, followed by suspension polymerization or emulsion polymerization to obtain a vinyl polymer or copolymer, during which a part of the acid anhydride units can be subjected to ring-opening to be converted into dicarboxylic acid units. At the time of the polymerization, another resin can be mixed in the polymerizable monomer. The resultant resin can be subjected to conversion into acid anhydride by heat treatment, ring-opening of acid anhydride by treatment with a weak alkaline water, or esterification with an alcohol.

Dicarboxylic acid and dicarboxylic anhydride monomers have a strong tendency of alternate polymerization, a vinyl copolymer containing functional groups, such as acid anhydride and dicarboxylic acid units in a random dispersed state may be produced in the following manner as a preferable method. A vinyl copolymer is formed from a dicarboxylic monoester monomer in solution polymerization, and the vinyl copolymer is dissolved in a monomer, followed by suspension polymerization to obtain a binder resin. In this process, all or a part of the dicarboxylic monoester units can be converted into anhydride units through de-alcoholic cyclization by controlling the condition for solvent removal after the solution polymerization. During the suspension polymerization, a part of the acid anhydride units may be hydrolyzed to cause ring-opening, thus providing dicarboxylic acid units.

The conversion into acid anhydride units in a polymer can be confirmed as a shift of infrared absorption of carbonyl toward a higher wave-number side than in the corresponding acid or ester. Thus, the formation or extinction of acid anhydride units may be conveniently confirmed by FT-IR (Fourier transform infrared spectroscopy).

The thus-obtained binder resin contains carboxyl group, acid anhydride group and dicarboxyl group uniformly dispersed therein, thus being able to provide a toner with satisfactory chargeability.

The polyester resin used in the present invention may preferably have a composition that it comprises 45–55 mol. % of alcohol component and 55–45 mol. % of acid component.

Examples of the alcohol component may include: diols, such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenol derivatives represented by the following formula (I):

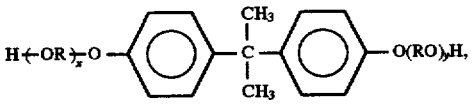

(I)

wherein R denotes an ethylene or propylene group, x and y are independently a positive integer with the proviso that the average of x+y is in the range of 2–10; diols represented by the following formula (II):

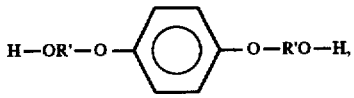

(II)

wherein R' denotes —$CH_2CH_2$—,

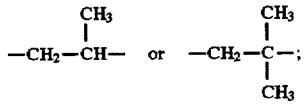

and polyhydric alcohols, such as glycerin, sorbitol and sorbitan.

Examples of the dibasic acid constituting at least 50 mol. % of the total acid component may include benzenedicarboxylic acids, such as phthalic acid, terephthalic acid and isophthalic acid, and their anhydrides; alkyldicarboxylic acids, such as succinic acid, adipic acid, sebacic acid and azelaic acid, and their anhydrides; $C_6$–$C_{18}$ alkyl or alkenyl-substituted succinic acids, and their anhydrides; and unsaturated dicarboxylic acids, such as fumaric acid, maleic acid, citraconic acid and itaconic acid, and their anhydrides.

Examples of polybasic carboxylic acids having three or more functional groups may include: trimellitic acid, pyromellitic acid, benzophenonetetracarboxylic acid, and their anhydride.

An especially preferred class of alcohol components constituting the polyester resin is a bisphenol derivative represented by the above formula (I), and preferred examples of acid components may include dicarboxylic acids inclusive of phthalic acid, terephthalic acid, isophthalic acid and their anhydrides; succinic acid, n-dodecenylsuccinic acid, and their anhydrides, fumaric acid, maleic acid, and maleic anhydride; and tricarboxylic acids such as trimellitic acid and its anhydride.

The polyester resins obtained from these acid and alcohol components are preferred as the binder resin because they provide a toner for hot roller fixation showing good fixability and excellent anti-offset characteristic.

The polyester resin may preferably have an acid value of at most 90, more preferably at most 50, and an OH (hydroxyl) value of at most 50, more preferably at most 30. This is because the resultant toner is caused to have a chargeability remarkably affected by environmental conditions if the number of terminal groups is increased.

The polyester resin may preferably have a glass transition temperature of 50°–75° C., particularly 55°–65° C., a number-average molecular weight (Mn) of 1,500–50,000, particularly 2,000–20,000, and a weight-average molecular weight (Mw) of 6,000–100,000, particularly 10,000–90,000.

The toner for developing electrostatic images according to the present invention can further contain a negative or positive charge control agent, as desired, for further stabilizing the chargeability. The charge control agent may preferably be used in an amount of 0.1–10 wt. parts, particularly 0.1–5 wt. parts, per 100 wt. parts of the binder resin.

Charge control agents known in the art may include the following.

Examples of the negative charge control agent for providing a negatively chargeable toner may include: organic metal complexes or chelate compounds inclusive of monoazo metal complexes and organometal complexes of aromatic hydroxycarboxylic acids and aromatic dicarboxylic acids. Other examples may include: aromatic hydroxycarboxylic acids, aromatic mono- and poly-carboxylic acids, and their metal salts, anhydrides and esters, and phenol derivatives, such as bisphenols.

Examples of the positive charge control agent for providing a positively chargeability toner may include: nigrosine and modified products thereof with alphatic acid metal salts, etc., onium salts inclusive of quaternary ammonium salts, such as tributylbenzylammonium 1-hydroxy-4-naphthosulfonate and tetrabutylammonium tetrafluoroborate, and photophonium salts having analogous structures, and lake pigments of these, triphenylmethane dyes and lake pigments thereof (the laking agents including: phosphotungstic acid, phosphomolybdic acid, phosphotungstomolybdic acid, tannic acid, lauric acid, gallic acid, ferricyanides and ferrocyanides), metal salts of higher fatty acids; diorganotin oxides, such as dibutyltin oxide, dioctyltin oxide, and dicyclohexyltin oxide; diorganotin borates, such as dibutyltin borate, dioctyltin borate and dicyclohexyltin borate; guanidine compounds, and imidazole compounds. These may be used singly or in combination of two or more species.

When the toner of the present invention is formulated as a magnetic toner, the toner contains a magnetic material as a (magnetic) colorant.

Examples of the magnetic material contained in such a magnetic toner may include: iron oxides, such as magnetite, hematite, and ferrite; magnetic iron oxides containing another metal oxide; metals, such as Fe, Co and Ni, and alloys of these metals with other metals, such as Al, Co, Cu, Pb, Mg, Ni, Sn, Zn, Sb, Be, Bi, Cd, Ca, Mn, Se, Ti, W and V; and mixtures of the above.

Specific examples of the magnetic material may include: triiron tetroxide ($Fe_3O_4$), diiron trioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), powdery iron (Fe), powdery cobalt (Co), and powdery nickel (Ni). The above magnetic materials may be used singly or in mixture of two or more species. Particularly suitable magnetic material for the present invention is fine powder of triiron tetroxide or $\gamma$-diiron trioxide.

The magnetic material may have an average particle size of 0.05–2 μm. The magnetic material may preferably show magnetic properties when measured by application of 795.8 kA/m, inclusive of: a coercive force (Hc) of 1.6–12.0 kA/m, a saturation magnetization (as) of 50–200 $Am^2/kg$, particularly 50–100 $Am^2/kg$, and a residual magnetization ($\sigma r$) of 2–20 $Am^2/kg$.

The magnetic material may be contained in the toner in a proportion of 10–200 wt. parts, preferably 20–150 wt. parts, per 100 wt. parts of the binder resin.

The toner according to the present invention may optionally contain a non-magnetic colorant, inclusive of arbitrary pigments or dyes.

Examples of the pigment may include: carbon black, aniline black, acetylene black, Naphthol Yellow, Hansa Yellow, Rhodamine Lake, Alizarine Lake, red iron oxide, Phthalocyanine Blue, and Indanthrene Blue. It is preferred to use 0.1–20 wt. parts, particularly 1–10 wt. parts, of a pigment per 100 wt. parts of the resin. For similar purpose, there may also be used dyes, such as anthraquinone dyes, xanthene dyes, and methine dyes, which may preferably be used in an amount of 0.1–20 wt. parts, particularly 0.3–10 wt. parts, per 100 wt. parts of the binder resin.

In the present invention, it is also possible to incorporate one or two or more species of release agent, as desired, within toner particles.

Examples of the release agent may include: aliphatic hydrocarbon waxes, such as low-molecular weight polyethylene, low-molecular weight polypropylene, microcrystalline wax, and paraffin wax, oxidation products of aliphatic hydrocarbon waxes, such as oxidized polyethylene wax, and block copolymers of these; waxes containing aliphatic esters as principal constituents, such as carnauba wax, sasol wax, montanic acid ester wax, and partially or totally deacidified aliphatic esters, such as deacidified carnauba wax. Further examples of the release agent may include: saturated linear aliphatic acids, such as palmitic acid, stearic acid, and montanic acid; unsaturated aliphatic acids, such as brassidic acid, eleostearic acid and parinaric acid; saturated alcohols, such as stearyl alcohol, arachidic alcohol, behenyl alcohol, carnaubyl alcohol, ceryl alcohol, and melissyl alcohol; long-chain alkyl alcohols; polyhydric alcohols, such as sorbitol; aliphatic acid amides, such as linoleylamide, oleylamide, and laurylamide; saturated aliphatic acid bisamides, such as methylene-bisstearylamide, ethylene-biscaprylamide, ethylene-bislaurylamide and hexamethylene-bisstearylamide; unsaturated aliphatic acid amides, such as ethylene-bisolerylamide, hexamethylene-bisoleylamide, N,N'-dioleyladipoylamide, and N,N'-dioleylsebacoylamide; aromatic bisamides, such as m-xylene-bisstearoylamide, and N,N'-distearylisophthalylamide; aliphatic acid metal salts (generally called metallic soap), such as calcium stearate, calcium laurate, zinc stearate, and magnesium stearate; grafted waxes obtained by grafting aliphatic hydrocarbon waxes with vinyl monomers, such as styrene and acrylic acid; partially esterified products between aliphatic acids and polyhydric alcohols, such as behenic acid monoglyceride; and methyl ester compounds having hydroxyl group as obtained by hydrogenating vegetable fat and oil.

The release agent may preferably be used in an amount of 0.1–20 wt. parts, particularly 0.5–10 wt. parts, per 100 wt. parts of the binder resin.

The release agent may be uniformly dispersed in the binder resin by a method of mixing the release agent in a solution of the resin at an elevated temperature under stirring or melt-kneading the binder resin together with the release agent.

The toner according to the present invention can optionally contain appropriate amounts of additives other than the inorganic fine powders (A) and (B). Particularly, an additive capable of improving the flowability after the external addition thereof to the toner particles without impairing the chargeability can be preferably used. Examples of such additives may include: resin particles inclusive of fluorine-containing resin powder, such as polyvinylidene fluoride fine powder or polytetrafluoroethylene powder; polyamide resin particles, silicone resin particles, silicone rubber particles, urethane resin particles, melamineformaldehyde resin particles and acrylic resin particles; particles of rubber and wax; composite particles comprising particles of inorganic substance, such as metal, metal oxide, salt and carbon black together with a resin; particles of fluorine-containing compounds, such as fluorinated carbon; particles of fatty acid metal salts, such as zinc stearate; particles of fatty acid or fatty acid derivatives, such as fatty acid esters; particles of molybdenum sulfide and particles of amino acides and amino acid derivatives.

The toner particles and the resultant toner may respectively preferably have a weight-average particle size ($D_4$) of 5.5–12 μm, more preferably 5.5–9 μm.

Various physical parameters referred to herein may be measured or determined according to the following methods.

(1) X-ray diffraction pattern

An X-ray diffraction pattern of a powdery sample comprising a composite metal oxide may be obtained by using the following apparatus:

X-ray diffraction apparatus ("CN2013", available from Rigaku Denki K.K.)

Powder molding machine ("PX-700", available from Sarmonics K.K.)

A powdery sample is molded (or pelletized) under compression by means of the above molding machine. The molded sample is set in the above X-ray diffraction apparatus and subjected to measurement of X-ray intensity under the following conditions:

Target, Filter: Cu, Ni

Voltage, Current: 32.5 KV, 15 mA

Counter: Sc

Time Constant: 1 Sec.

Divergence Slit: 1 deg.

Receiving Slit: 0.15 mm

Scatter Slit: 1 deg.

Angle Range: 60–20 deg.

From the thus-obtained peak intensities and corresponding bragg angles (2θ), the structure of the sample can be identified.

(2) Complex metal oxide content (within toner particles)

The composite metal oxide content in toner particles may be determined by using a calibration curve and the following apparatus:

Fluorescent X-ray spectrometer ("3080", available from Rigaku Denki K.K.)

Press Molding machine ("MAEKAWA Testing Machine", available from MFG Co., Ltd.)

(i) Preparation of calibration curve

A prescribed toner sample (X) is blended with prescribed proportions (shown below) of a composite metal oxide powder in a coffee mill to prepare seven powdery samples for a calibration curve:

0 wt. %, 0.5 wt., %, 1.0 wt. %, 2.0 wt. %, 3.0 wt. %, 5.0 wt. %, and 10.0 wt. %.

The thus-prepared 7 samples are press-molded by using the above press molding machine, respectively.

Based on 2θ table, a Kα peak angle (a) of a metallic element [M] within the double oxide particles is determined.

The respective samples for the calibration curve is set in a sample chamber of the above fluorescent X-ray spectrometer and the sample chamber is reduced in pressure to provide a vacuum state.

The calibration curve is prepared by obtaining X-ray intensities of the respective samples under the following conditions:

Measurement voltage (potential) and current: 50 kV, 50 mA

2θ angle (bragg angle): a

Crystal plate: LiF

Measurement time: 60 sec.

(ii) Quantification of composite metal oxide within toner samples

A powdery sample is press molded and subjected to measurement of X-ray intensity in the same manner and under identical conditions as in the above (i). From the measured X-ray intensity, the composite metal oxide content is determined by using the above-prepared calibration curve.

(3) Particle size distribution

The particle size distribution of a powdery sample described herein is based on measurement by using a Coulter counter while it may be measured in various manners.

A Coulter counter ("Multisizer Type-II", available from Coulter Electronics Inc.) is used as an instrument for measurement, to which an interface (available from Nikkaki K.K.) for providing a number-basis distribution, and a volume-basis distribution and a personal computer CX-1 (available from Canon K.K.) are connected.

For measurement, a 1%-NaCl aqueous solution as an electrolytic solution is prepared by using a reagent-grade sodium chloride. Into 100 to 150 ml of the electrolytic solution, 0.1 to 5 ml of a surfactant, preferably an alkylbenzenesulfonic acid salt, is added as a dispersant, and 2 to 20 mg of a sample is added thereto. The resultant dispersion of the sample in the electrolytic liquid is subjected to a dispersion treatment for about 1–3 minutes by means of an ultrasonic disperser, and then subjected to measurement of particle size distribution by using the above-mentioned Coulter counter Multisizer Type-II with a 100 μm-aperture for a toner sample or a 13 μm-aperture for an inorganic fine powder sample to obtain a volume-basis distribution and a number-basis distribution. From the results of the volume-basis distribution and number-basis distribution, parameters characterizing the toner or inorganic fine powder of the present invention may be obtained. More specifically, the weight-basis average particle size ($D_4$) may be obtained from the volume-basis distribution.

(4) Specific surface area of inorganic fine powder

The specific surface area of an inorganic fine powder sample is measured by using a flow-type specific surface area automatic measurement apparatus ("Micromeritics Flowsorb II", available from Shimadzu Seisakusho K.K.). A sample in an amount of 0.2 g is subjected to measurement by using a mixture gas stream of 30 vol. % of nitrogen and 70 mol. % of helium after a degassing treatment at 70° C. for 30 min.

(5) Hydrophobicity of inorganic fine powder 1.0 g of sample is weighed into a 250 $cm^3$-tightly stoppable plastic bottle, and 100 $cm^3$ of deionized water is measured into the bottom to tightly stop the bottle. The bottom is shaked at a speed of 1.5 cycles/sec for 10 min. After the shaking, a lower portion liquid in the plastic bottle is sampled into a cell and, after 1 min. of standing, is subjected to measurement of transmittance at a wavelength of 500 nm by using a spectrophotometer ("U-BEST-50", available from, JASCO Corp.), whereby the measured transmittance is used as an indication of hydrophobicity.

Figure 6:
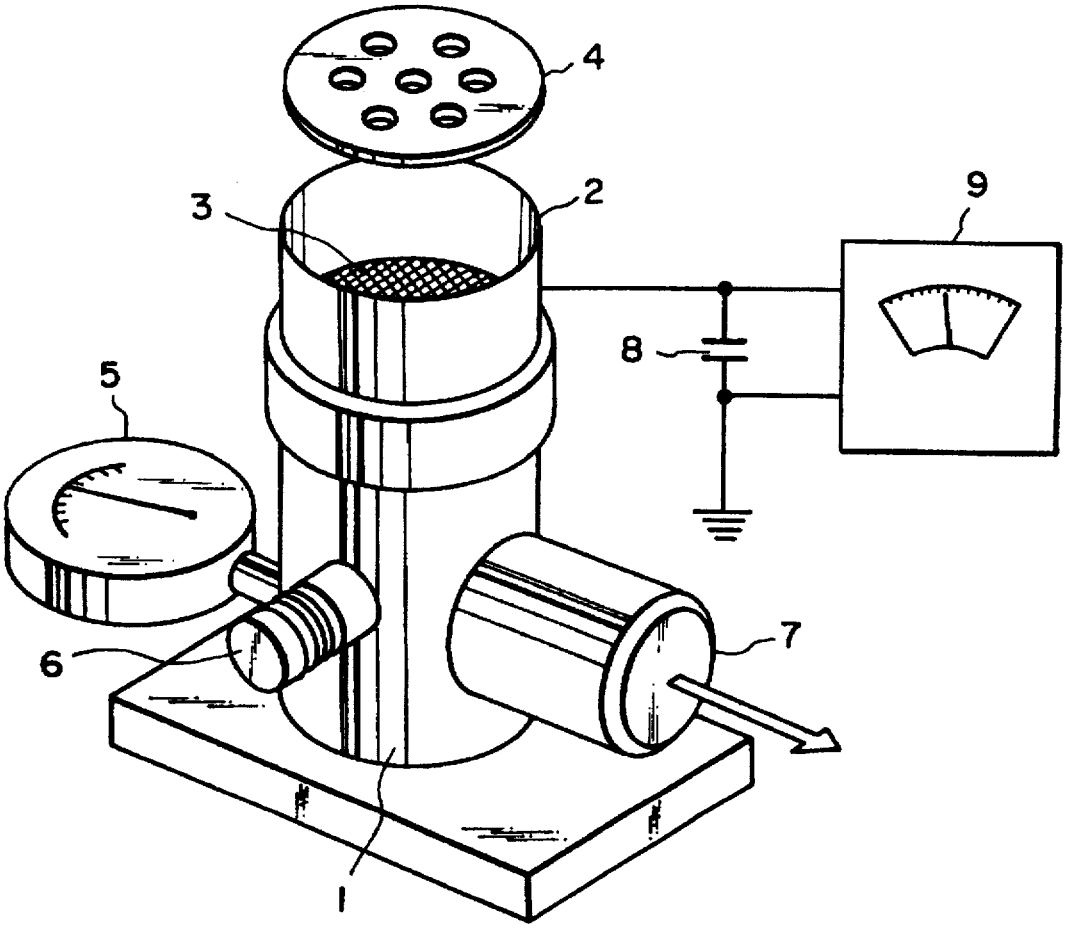
FIG. 6 is an illustration of an apparatus for measuring a triboelectric charge of a powdery sample.

(6) Charge of inorganic fine powder (FIG. 6)

A powdery sample (details thereof will be described in respective Examples appearing hereinafter) is weighed and placed in a metal-made container 2 equipped with an electroconductive screen 3 of 500 mesh (the size can be appropriately changed so as not to pass the iron or magnetic particles) and then covered with a metal lid 54. The total weight of the container 2 is weighed at $W_1$ (g). Then, an aspirator 1 composed of an insulating material at least with respect to a part contacting the container 2 is operated, and the fine powder in the container is removed by sucking through a suction port 7 sufficiently (for ca. 2 min.) while controlling the pressure at a pressure gauge 5 at 250 mmAq by adjusting an aspirator control valve 6. The reading at this time of a potential meter 9 connected to the container 2 via a capacitor 8 having a capacitance C (μF) is denoted by V (volts). The total weight of the container after the aspiration is weighed at $W_2$ (g). Then, the triboelectric charge T of the fine powder is calculated as $T\ (mC/kg)=CxV/(W_1-W_2)$.

(7) Detection of inorganic fine powder from a toner 5 g of a toner sample in mixture with 500 $cm^3$ of methanol is subjected to ultrasonic dispersion for ca. 1–3 min. In the case of a magnetic toner sample, the dispersion is left standing for 30 min. over a magnet. The resultant supernatant liquid is filtrated through a membrane filter (available from Sumitomo Denko K.K.) having an opening size of 0.5 μm, and the filtrate is subjected to two times of ultrasonic dispersion filtration. From the resultant dry solid matter (b) on the filtrate is further filtrated under suction through a 0.2 μm-membrane filter, and the substance on the filter is subjected to ultrasonic dispersion in 100 $cm^3$ of toluene. The toluene solution or dispersion is dried to a solid (a), from which inorganic fine powder (A) is detected. The solid (a) may be subjected to measurement according to the above-described items (2)–(6), and also quantitative analysis, such as Infrared Absorption Spectrometry (IR), etc.

Silicone oil in the inorganic fine powder (A) may be detected by subjecting the above recovered solid (a) to a measurement by using a gas chromatography mass analyzer (P-GC/MS) as follows.

Apparatus

A system composed of the following three types in association:

Curic Patent Pyrolyser ("JHP223", available from JAPAN ANALYTICAL INDUSTRY)

Gas chromatograpy ("5890A", available from HEWLETT PACKARD CO.)

Mass Spectometry ("TRIORI", available from VG INSTRUMENT CO.)

Measurement conditions

Pyrofoil: 590° C.

Decomposition time: 4 sec.

Oven temp.: 150° C.

Transfer line temp.: 180° C.

Carrier gas: helium

Flow rate: 50 ml/min.

Column: DB-1 (mfd. by J & W)

Column temp.: 50° C.→150° C., up rate: 2° C./min

Injection port temp.: 180° C.

Split ratio: 50/1

Linear velocity: 30 cm/sec

Procedure

1) Tuning and calibration of Q-pole is performed.

2) 0.1–1 mg of a sample is wrapped with a pyro-foil.

3) The pyro-foil prepared in 2) above is set in a Pyrolyser, and the sample introduction part is purged, followed by waiting for 10 min.

4) Measurement is started.

5) After the measurement, the mass spectra of respective peaks of the resultant chromatogram are compared with standard spectra to identify the measured sample.

(8) Acid value of vinyl-the resin

Qualitative and quantitative analysis of functional groups may be performed, for example, by application of infrared absorption spectrometry, acid value measurement according to JIS K-0070 and acid value measurement by hydrolysis (total acid value measurement).

For example, in the infrared (IR) absorption, the presence of an acid anhydride fraction can be confirmed by an absorption peak in the neighborhood of 1780 $cm^{-1}$ attributable to the carbonyl group in the acid anhydride.

Herein, the IR-absorption spectrum peak refers to a peak which is recognizable after 16 times of integration by FT-IR having a resolution of 4 $cm^{-1}$. A commercially available example of the FT-IR apparatus is "FT-IR 1600" (available from Perkin-Elmer Corp.).

The measurement of acid value according to JIS K-0070 (hereinafter referred to as "JIS acid value") provides an acid value of an acid anhydride which is about 50% of the theoretical value (based on an assumption that a mol of an acid anhydride provides an acid value identical to the corresponding dicarboxylic acid).

On the other hand, the total acid value (A) measurement provides an acid value which is almost identical to the theoretical value. Accordingly, the acid value attributable to an acid anhydride group per g of a resin can be obtained in the following manner:

$$\text{total acid value (B)}=[\text{total acid value (A)}-\text{JIS acid value}]\times 2.$$

For example, in the case of preparing a vinyl-type copolymer composition used as a binder resin by using maleic acid monoester as an acid component through solution polymerization and suspension polymerization, the total acid value (B) of a vinyl-type copolymer formed in the solution polymerization can be calculated by measuring the JIS acid value and the total acid value (A) of the vinyl copolymer, and the amount (e.g., in terms of mol. %) of the acid anhydride formed during the polymerization step and the solvent removal step can be calculated from the total acid value and the vinyl monomer composition used in the solution polymerization. Further, the vinyl copolymer prepared in the solution polymerization is dissolved in monomers, such as styrene and butyl acrylate to prepare a monomer composition, which is then subjected to suspension polymerization. In this instance, a part of the acid anhydride groups causes ring-opening. The contents of dicarboxylic acid group, acid anhydride group and dicarboxylic acid monoester group of the vinyl copolymer composition after the suspension polymerization used as the binder resin can be calculated from the JIS acid value, total acid value (A) of the vinyl copolymer composition obtained by the suspension polymerization, the monomer composition for the suspension polymerization and amount of the vinyl copolymer prepared in the solution polymerization.

The total acid value (A) of a binder resin used herein is measured in the following manner. A sample resin in an amount of 2 g is dissolved in 30 ml of dioxane, and 10 ml of pyridine, 20 mg of dimethylaminopyridine and 3.5 ml of water are added thereto, followed by 4 hours of heat refluxing. After cooling, the resultant solution is titrated with 1/10 N-KOH solution in THF (tetrahydrofuran) to neutrality with phenolphthalein as the indicator to measure the acid value, which is a total acid value (A). Under the condition for the measurement of the total acid value (A), an acid anhydride group is hydrolyzed into dicarboxylic acid groups, but an acrylic ester group, a methacrylic ester group or a dicarboxylic monoester group is not hydrolyzed.

The above-mentioned 1/10 N-KOH solution in THF is prepared as follows. First, 1.5 g of KOH is dissolved in about 3 ml of water, and 200 ml of THF and 30 ml of water are added thereto, followed by stirring. After standing, a uniform clear solution is formed, if necessary, by adding a small amount of methanol if the solution is separated or by adding a small amount of water if the solution is turbid. Then, the factor of the 1/10 N-KOH/THF solution thus obtained is standardized by a 1/10 N-HCl standard solution.

The binder resin may have a total acid value (A) of 2–100 mgKOH/g, but it is preferred that the vinyl copolymer containing an acid component in the binder resin has a JIS acid value of below 100. If the JIS acid value is 100 or higher, the functional group such as carboxyl group and acid anhydride group are contained at a high density, so that it becomes difficult to obtain a good balance of chargeability and the dispersibility thereof is liable to be problematic even when it is used in a diluted form.

(9) Acid value of polyester resin

2–10 g of a sample resin is weighed in a 200 to 300 ml-Erlenmeyer flask, and about 50 ml of a methanol/toluene (=30/70) mixture solvent is added thereto to dissolve the resin. In case of poor solubility, a small amount of acetone may be added. The solution is titrated with an N/10 KOH/alcohol solution standardized in advance with the use of a 0.1 indicator mixture of bromothymol blue and phenolphthalein. The acid value is calculated from the consumption of the KOH/alcohol solution based on the following equation:

Acid value=vol. (ml) of KOH/alcohol×N=56.1/sample weight, wherein N denotes the factor of the N/10 KOH/alcohol solution.

(10) Glass transition temperature Tg

Measurement of Tg of a binder resin may be performed in the following manner by using a differential scanning calorimeter (e.g., "DSC-7", available from Perkin-Elmer Corp.).

A sample in an amount of 5–20 mg, preferably about 10 mg, is accurately weighed.

The sample is placed on an aluminum pan and subjected to measurement in a temperature range of 30°–200° C. at a temperature-raising rate of 10° C./min in a normal temperature-normal humidity environment in parallel with a black aluminum pan as a reference.

In the course of temperature increase, a main absorption peak appears in the temperature region of 40°–100° C.

In this instance, the glass transition temperature (Tg) is determined as a temperature of intersection of a DSC curve with an intermediate line passing between the base lines obtained before and after the appearance of the absorption peak.

Next, the image forming method and process-cartridge according to the present invention will now be described.

A specific embodiment of image forming apparatus usable for practicing the image forming method according to the present invention is described with reference to FIG. 3.

Figure 3:
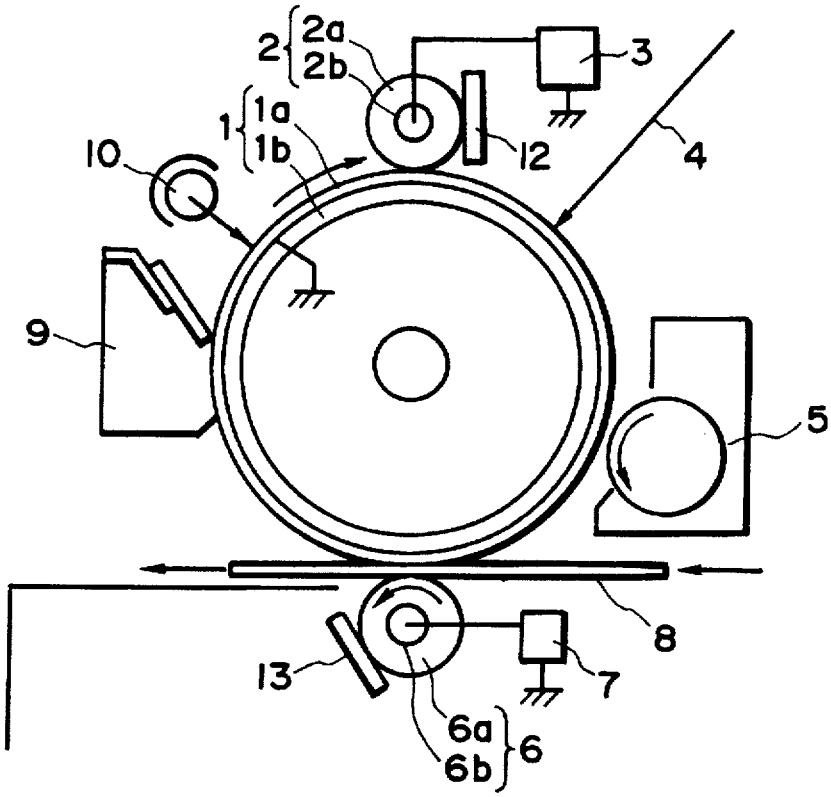
FIG. 3 is a schematic illustration of an image forming step used in an embodiment of the image forming method according to the invention.

Referring to FIG. 3, the apparatus includes an electrostatic image bearing member 1 in the form of a rotatable drum (photosensitive member). The photosensitive member 1 basically comprises an electroconductive substrate 1*b* and a photoconductor layer 1*a* on its outer surface. The surface portion of the photoconductor layer 1*a* comprises a polycarbonate resin containing a charge-transporting substance and 8 wt. % of fluorine-containing resin powder. The photosensitive member 1 rotates in a clockwise direction in an as-shown state at a prescribed speed of, e.g., 200 mm/sec.

A charging roller 2 as a contact-charging member functioning as a primary charging means basically comprises a core metal 2*a* and an electroconductive elastic layer 2*b* of, e.g., epichlorohydrin rubber containing carbon black, disposed to surround the core metal 2*a*.

The charging roller 2 is pressed against the photosensitive member 1 surface at a linear pressure of, e.g., 40 g/cm and is rotated following the rotation of the photosensitive member 1. To the charging roller 2, a felt pad 12 is abutted as a cleaning member.

A charging bias voltage supply 3 is disposed to apply a voltage of, e.g., DC −1.4 kV to the charging roller 2, thereby charging the photosensitive member 1 surface at a polarity and potential of ca. −700 V.

Then, an electrostatic image is formed on the photosensitive member 1 by exposure to image light 4 as electrostatic image-forming means and then visualized a a toner image with a toner held in a developing means 5. A transfer roller 6 as a contact-transfer member basically comprises a core metal 6*b* and an electroconductive elastic layer 6*a* of, e.g., ethylene-propylene-butadiene copolymer containing carbon black, disposed to surround the core metal 6*b*.

The transfer roller 6 is abutted against the photosensitive member 1 surface at a linear pressure of, e.g., 20 g/cm, and is rotated at a peripheral seed equal to that of the photosensitive member 1. Further, a felt pad 13 as a cleaning member is abutted to the transfer roller 6.

A transfer-receiving material 8 in this embodiment is A4-size paper, which is conveyed to between the photosensitive member 1 and the transfer roller 6 and, simultaneously therewith, a bias voltage of, e.g., DC −5 kV of a polarity opposite to that of the toner is applied to the transfer roller 6 from a transfer bias voltage supply 7, whereby the developed toner image on the photosensitive member 1 is transferred onto the face side of the transfer-receiving material 8. Accordingly, the transfer roller is pressed against the photosensitive member 1 via the transfer-receiving material 8 at the time of transfer.

Then, the toner image is fixed onto the transfer-receiving material 8 and the transfer-receiving material 8 carrying the fixed toner image is discharged as an image product.

The photosensitive member 1 surface after the toner image transfer is subjected to cleaning of soiling substance, such as transfer residual toner, by a cleaning device 9 equipped with an elastic cleaning blade of basically polyurethane rubber pressed against the photosensitive member 1 in a counter direction at a line pressure of, e.g., 25 g/cm, and then to charge-removal by a discharging exposure device 10, to be used for a subsequent image forming cycle.

In the image forming method according to the present invention, the toner image may preferably be heat-fixed under heating onto a transfer receiving material, such as plain paper or a transparent sheet for an overhead projector (OHP), by a contact heating means.

The contact heat-fixing means may for example be a hot-pressure roller fixation apparatus or a hot fixation device including a fixed heating member and a pressing member disposed opposite to the heating member so as to be pressed toward the heating member and cause a transfer material to contact the heating member via a film.

Figure 4:
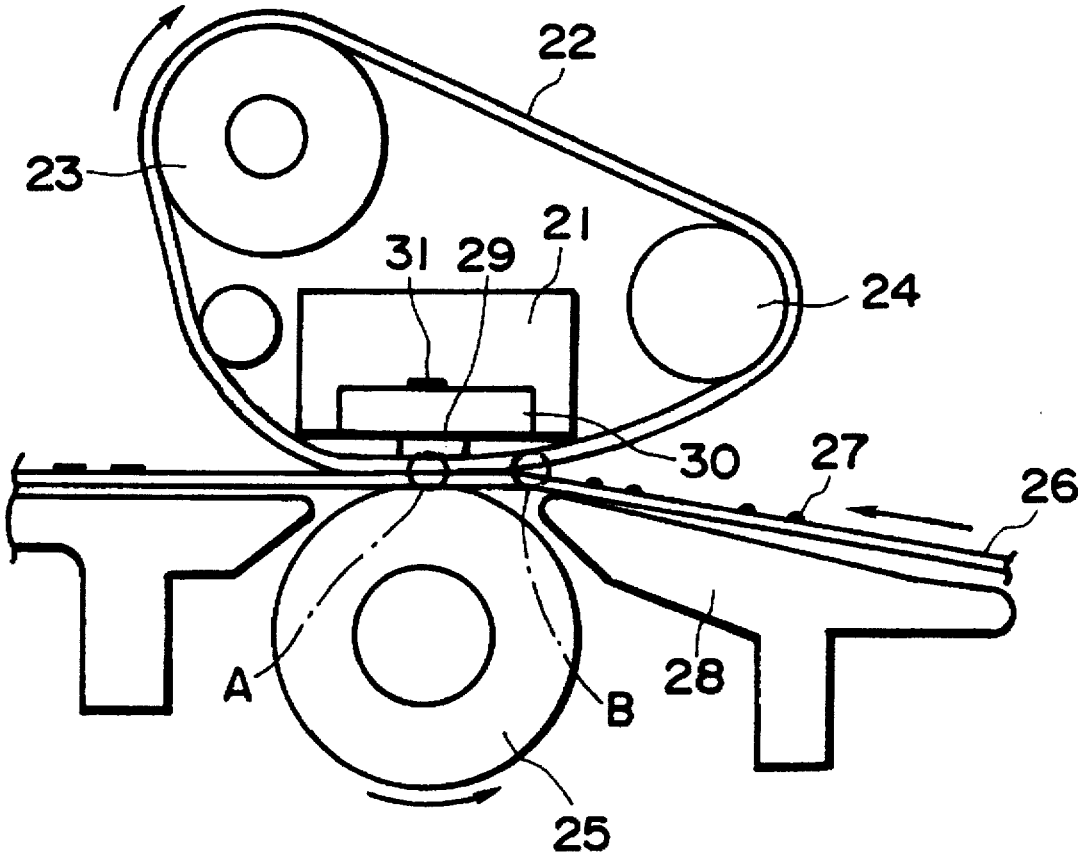
FIG. 4 is a schematic illustration of a fixing step used in an embodiment of the image forming method according to the invention.

An embodiment of the fixing device is illustrated in FIG. 4.

Referring to FIG. 4, the fixing device includes a heating member which has a heat capacity smaller than that of a conventional hot roller and has a linear heating part exhibiting a maximum temperature of preferably 100°–300° C.

The film disposed between the heating member and the pressing member may preferably comprise a heat-resistant sheet having a thickness of 1–100 μm. The heat-resistant sheet may comprise a sheet of a heat-resistant polymer, such as polyester, PET (polyethylene terephthalate), PFA (tetrafluoro-ethylene-perfluoroalkyl vinyl ether copolymer), PTFE (polytetrafluoroethylene), polyimide, or polyamide; a sheet of a metal such as aluminum, or a laminate of a metal sheet and a polymer sheet.

The film may preferably have a release layer and/or a low resistivity layer on such a heat-resistant sheet.

An embodiment of the fixing device will be described with reference to FIG. 4.

The device includes a low-heat capacity linear heating member 21, which may for example comprise an aluminum substrate 30 of 1.0 mm-t×10 mm-W×250 mm-L, and a resistance material 29 which has been applied in a width of 1.0 mm on the aluminum substrate and is energized from both longitudinal ends. The energization is performed by applying pulses of DC 100 V and a cycle period of 20 msec while changing the pulse widths so as to control the evolved heat energy and provide a desired temperature depending on the output of a temperature sensor 31. The pulse width may range from ca. 0.5 msec to 5 msec. In contact with the heating member 21 thus controlled with respect to the energy and temperature, a fixing film 22 is moved in the direction of an indicated arrow. The supplied current need not be in the form of pulses.

The fixing film 22 may for example comprise an endless film including a 20 μm-thick heat-resistant film (of, e.g., polyimide, polyether imide, PES or PFA, provided with a coating of a fluorine-containing-resin such as PTFE or PAF on its image contact side) and a 10 μm-thick coating release layer containing an electroconductive material therein. The total thickness may generally be less than 100 μm preferably less than 40 μm. The film is driven in the arrow direction under tension between a drive roller 23 and a mating roller 24.

The fixing device further includes a pressure roller 25 having a releasable elastomer layer of, e.g., silicone rubber and pressed against the heating member 21 via the film at a total pressure of 4–20 kg, while moving together with the film in contact therewith. A transfer(-receiving) material 26 carrying an unfixed toner image 27 is guided along an inlet guide 28 to the fixing station to obtain a fixed image by the heating described above.

The above-described embodiment includes a fixing film in the form of an endless belt but the film can also be an elongated sheet driven between a sheet supply axis and a sheet winding axis.

In the above described fixing system, the heating member has a rigid flat surface so that the transfer material at the fixing nip is pressed in a flat state by the pressure roller to fix the toner image thereon. Further, because of the structure, the gap between the fixing film and the transfer material is narrowed at a position (B) immediately before the transfer material enters the nip, so that air between the fixing film and the transfer material is pushed out toward the rear direction.

Under such state, if a line image on the transfer material enters in the longitudinal direction of the heating member, air is pushed out toward the line image. In this instance, if the toner image is put lightly on the line, the pushed air goes out toward the rear side while scattering the developer particles therewith.

Particularly, when the transfer paper is not so smooth or is wet, the transfer electric field is weakened and the toner image is only weakly pulled toward the transfer paper. In such a case, the above-mentioned scattering of the toner image is liable to occur. Further, in case of a large process speed, the scattering becomes noticeable because of an increased air pressure.

However, as the toner according to the present invention contains the inorganic fine powders (A) and (B), the toner can be provided with a high charge under any environmental conditions without causing coating irregularities on the sleeve, so that the fixation scattering liable to be caused in the above-mentioned fixing system can be prevented.

The inorganic fine powder (A) treated at least with silicone oil has a moisture resistance and accordingly can provide the toner in the developing device with high charge and high flowability even in a high humidity environment. However, this technique of providing an increased charge is liable to cause an excessive charge of toner in a low humidity environment leading to coating irregularities on the sleeve. Accordingly, as a method of further increasing the coating irregularities on the sleeve, it becomes effective to incorporate in the toner the inorganic fine powder (B) having a specific particle size. Because of the particle size and the charging characteristic, the inorganic fine powder (B) is caused to moderately coat the sleeve to obviate an excessive charge of the toner. Further, the toner particles are charge-impaired not only from the sleeve but also by contact with the inorganic fine powder (B), so that the toner according to the present invention is caused to have a high charge not only on the sleeve but also on the photosensitive member. Accordingly, when a transfer electric field is applied to the toner of the present invention, the toner particles can be charge-induced to be strongly attracted to the transfer-receiving material or cause electrostatic agglomeration, thus being placed tightly on a line image so that the scattering thereof can be alleviated.

The toner of the present invention can be provided with a rather high charge also by triboelectrification, so that the toner charge on the electrostatic image-bearing member is high, and the toner image thereon is strongly transferred under the action of a transfer electric field. This is also advantageous for preventing the toner scattering.

An embodiment of the image forming method according to the present invention has been described above. However, the charging roller as a contact-charging member (primary charging means) may be replaced by another contact-charging member, such as a charging blade or a charging brush or can even be replaced with a non-contacting corona charger. However, a contact-charging member is preferred in view of less occurrence of ozone during the charging.

As for transfer means, the contact transfer means, such as the transfer roller, can be replaced with a non-contacting corona transfer means, but the contact transfer means is preferred in view of less occurrence of ozone during the transfer.

Figure 5:
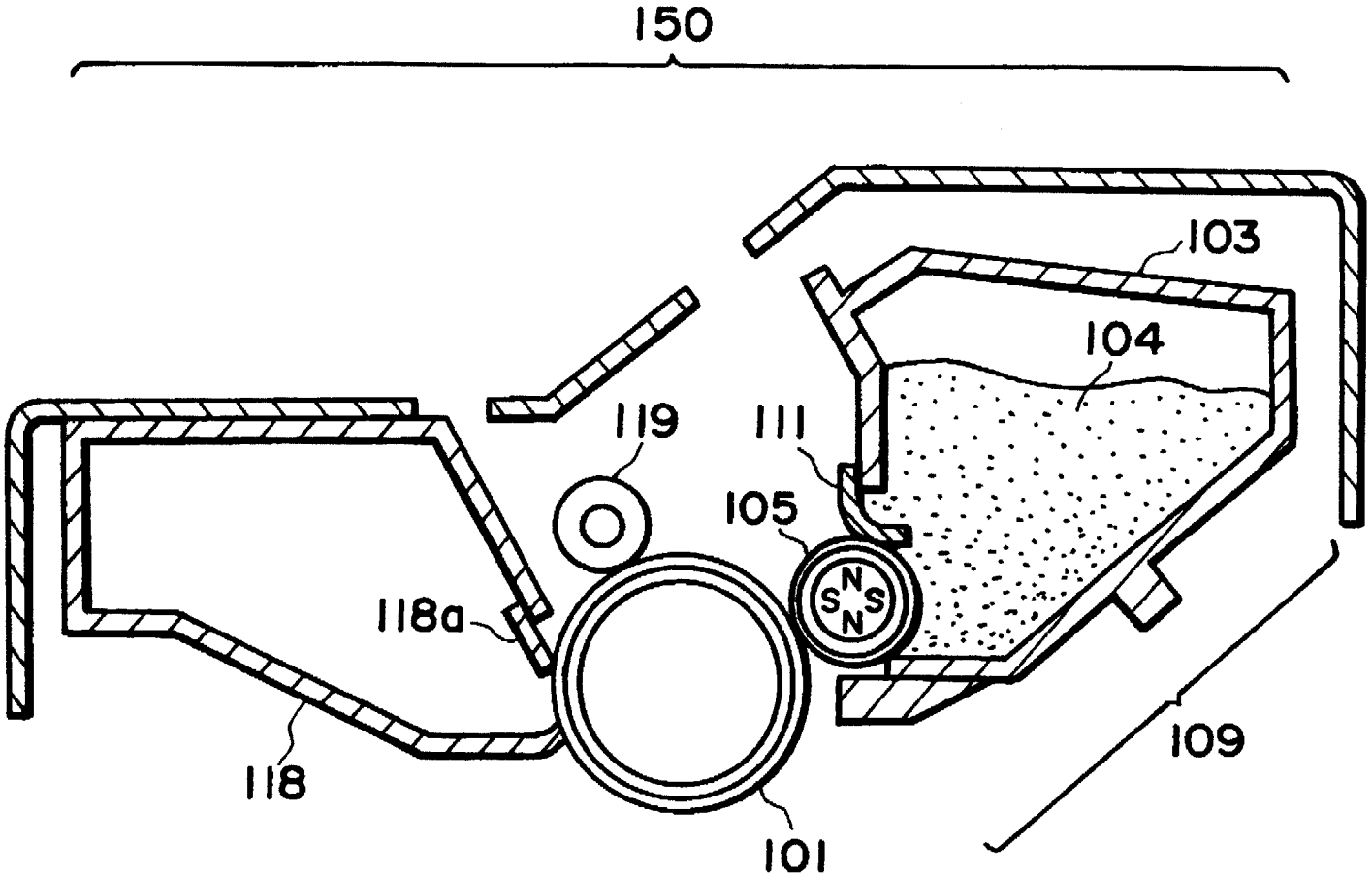
FIG. 5 is a schematic illustration of an embodiment of the process-cartridge according to the invention.

An embodiment of the process-cartridge according to the present invention is illustrated in FIG. 5, wherein members having similar fractions as in the image forming apparatus in FIG. 3 are denoted by like reference numbers.

The process cartridge according to the present invention includes at least a developing means and an electrostatic image-bearing member, which are integrally assemble to form a cartridge, which is detachably mountable to a main assembly of image forming apparatus (such as a copying machine, a laser beam printer or a facsimile apparatus).

Referring to FIG. 5, a process-cartridge 150 according to this embodiment is shown to integrally include a developing means 109, a drum-shaped electrostatic image-bearing member (photosensitive member) 101, a cleaning means 118 equipped with a cleaning blade **118*a*, and a primary charging means (charging roller) 119**.

In this embodiment, the developing means 109 includes an elastic regulation blade 111 and a developing vessel 103 containing a mono-component type developer 104 comprising a magnetic toner. At the time of development, a prescribed electric field is formed between the photosensitive member 101 and the developing sleeve 105 by a developing bias voltage applied from a bias voltage application means disposed within the main assembly to effect a development step using the developer 104. In order to suitably perform the developing step, the gap between the photosensitive member 101 and the developing sleeve is very important.

The process-cartridge in the above-described embodiment integrally comprises four members, i.e., a developing means, an electrostatic image-bearing member, a cleaning means and a primary charging means. However, the process-cartridge according to the present invention integrally includes at least two members of a developing means and an electrostatic image-bearing member in the form of a cartridge. Accordingly, the process-cartridge of the present invention can also be constituted as a cartridge including three members of the developing means, the electrostatic image-bearing member and the cleaning means; or three members of the developing means, the electrostatic image-bearing member and the primary charging means; or another combination including another member in addition to the developing means and the electrostatic image-bearing member.

hydrolysis to result in titanium oxide particles. Then, a prescribed amount of dimethylsilicone was vaporize at 200° C. in a vaporizer of nitrogen atmosphere and introduced into the reactor immediately after the formation of the titanium oxide particles. After the above operations all performed under a nitrogen gas stream, the treated particles were recovered by a filter.

TABLE 1

| Inorganic fine powder A | Particles treated*1 | Silicone oil Species*3 | Viscosity ($mm^2/S$) | Amount (wt. parts) | Specific surface area ($m^2/g$) | Hydrophobicity (%) | Charge Q1 (mC/kg) |
|---|---|---|---|---|---|---|---|
| A-a | silica (dry) | DMS | 50 | 10 | 150 | 98 | −195 |
| A-b*2 | silica (dry) | DMS | 50 | 10 | 124 | 99.5 | −200 |
| A-c | silica (dry) | DMS | 50 | 10 | 70 | 97.6 | −198 |
| A-d | silica (dry) | DMS | 50 | 12 | 90 | 97.3 | −204 |
| A-e | silica (dry) | DMS | 50 | 14 | 350 | 97.2 | −208 |
| A-f | silica (dry) | DMS | 50 | 16 | 390 | 97.1 | −204 |
| A-g | silica (dry) | DMS | 50 | 3 | 190 | 97 | −195 |
| A-h | silica (dry) | DMS | 50 | 5 | 170 | 97 | −186 |
| A-i | silica (dry) | DMS | 50 | 35 | 115 | 97.2 | −178 |
| A-j | silica (dry) | DMS | 50 | 50 | 95 | 97.2 | −173 |
| A-k | silica (dry) | DMS | 90 | 8 | 160 | 96 | −159 |
| A-l | silica (wet) | DMS | 50 | 19 | 113 | 97.1 | −140 |
| A-m | titania | DMS | 50 | 10 | 135 | 97 | −157 |
| A-n | silica (wet) | — | — | — | 192 | 71 | −96 |

*1: silica (dry) means dry-process silica, and silica (wet) means wet-process silica.
*2: Treated with 25 wt. parts of dimethyldisilazane prior to the silicone treatment.
*3: DMS: dimethylsilicone Hereinbelow, the present invention will be described more specifically based on Production Examples and Examples, which however should not be construed to restrict the scope of the present invention.

Production Examples for inorganic fine powder (A)

Inorganic fine powder (A) treated with silicone oil was prepared in the following manner.

Into a closed high-speed stirring mixer, 20 g of particles to be treated (silica) were placed and the atmosphere was replaced by nitrogen. Under a moderate stirring, a treating agent (dimethylsilicone) optionally diluted with an appropriate amount of n-hexane was sprayed. Further, 180 g of particles to be treated were added and, simultaneously therewith, the remainder of prescribed amount of the treating agent was sprayed. After the addition, the content was stirred for 10 min at room temperature, followed by high-speed stirring, heating to 300° C. and 1 hour of stirring. While continuing the stirring, the system was cooled to room temperature, and the content powder was taken out from the mixer and disintegrated by a hammer mill to obtain inorganic fine powder (A-a).

In similar manners, inorganic fine powders (A-b) to (A-m) shown in Table 1 were prepared.

Among them, inorganic fine powder (A-b) was prepared by treating the silica by spraying 25 wt. parts of hexamethyldisilazane and with 2 hours of heating at 200° C., prior to the silicone oil treatment.

Inorganic fine powder (A-m) was prepared in the following manner.

A volatile titanium compound (titanium tetraisopropoxide) was vaporized at 200° C. in a vaporizer of nitrogen atmosphere. Separately, water was vaporized in a vaporizer of nitrogen atmosphere and introduced into a heater at 500° C. The vaporized titanium compound and the heated steam were introduced into a reactor to cause Production Examples for inorganic fine powder (B)

Inorganic fine powder (B) comprising Si-containing composite metal oxide was prepared in the following manner.

1400 g of strontium carbonate and 500 g of silicon oxide were wet-blended for 8 hours in a ball mill, filtered out and dried. The mixture was pelletized at a pressure of 5 $kg/cm^2$ and calcined at 1300° C. for 8 hours to obtain a composite metal oxide. The composite metal oxide was mechanically pulverized to obtain inorganic fine powder (B-a) having a weight-average particle size ($D_4$) of 2.1 μm and a number-average particle size ($D_1$) of 1.0 μm. Then, inorganic fine powder (B-a) was subjected to X-ray diffraction to provide an X-ray diffraction pattern in FIG. 1, whereby it was confirmed that inorganic fine powder (B-a) comprised composite metal oxides of $SrSiO_3$ (a=1, b=1, c=4), and $Sr_2SiO_4$ (a=2, b=1, c=4).

Inorganic fine powders (B-b) and (B-i) shown in Table 2 were prepared in similar manners as above except that a mixture of 1950 g of strontium carbonate and 1050 g of titanium oxide was calcined for preparation of inorganic fine powder (B-h), and a mixture of 2520 g of magnesium carbonate and 1800 g of silicon oxide was calcined for preparation of inorganic fine powder (B-i).

TABLE 2

| Inorganic fine powder (B) | Composite metal oxide | $D_4$ (μM) | Charge \|Q2\| (mC/kg) |
|---|---|---|---|
| B-a | strontium silicate | 2.1 | 8.9 |
| B-b | " | 0.2 | 2.4 |
| B-c | " | 0.4 | 3.8 |
| B-d | " | 0.9 | 4.4 |
| B-e | " | 2.8 | 8.6 |

TABLE 2-continued

| Inorganic fine powder (B) | Composite metal oxide | $D_4$ (μM) | Charge \|Q2\| (mC/kg) |
|---|---|---|---|
| B-f | " | 4.1 | 6.3 |
| B-g | " | 5.6 | 3.6 |
| B-h | strontium titanate | 2.4 | 3.5 |
| B-i | magnesium silicate | 2.7 | 3.1 |

EXAMPLE 1

| | |
|---|---|
| Binder resin (polyester resin) (Tg = 60° C., acid value = 23 mgKOH/g, hydroxyl value = 31 mgKOH/g, main peak molecular weight (Mp) = 7200, Mn = 3200, Mw = 57000) | 100 wt. parts |
| Magnetic iron oxide (Dav. = 0.16 μm; Hc = 9.2 kA/m, σs = 83 $Am^2/kg$), σr = 11.5 $Am^2/kg$, at a magnetic field of 795.8 kA/m) | 90 wt. parts |
| Monoazo metal complex (negative charge control agent) | 1 wt. part |
| Polypropylene wax | 3 wt. parts |

The above ingredients were blended in a Henschel mixer and melt-kneaded at 130° C. through a twin-screw extruder. After cooling, the kneaded product was coarsely crushed by a cutter mill and finely pulverized by a jet mill, followed by classification by a pneumatic classifier, to obtain negatively chargeable magnetic toner particles (X) having a weight-average particle size ($D_4$) of 6.4 μm.

To 100 wt. parts of the magnetic toner particles (X), 1.0 wt. parts of inorganic fine powder (A-a) and 3.0 wt. parts of inorganic fine powder (B-a) were externally added, and the mixture was blended by a Henschel mixer to obtain negatively chargeable Magnetic toner (X-1) with $D_4$=6.4 μm.

[Evaluation 1]

In the course of preparation of the magnetic toner particles (X) in Example 1, 1 kg of the toner particles in the stage after the melt-kneading and the coarse crushing by a cutter mill were subjected to sieving to recover a fraction of 60 mesh (opening=250 μm)-pass and 100 mesh (opening=150 μm)-on as Carrier (C) for measurement of triboelectric charge ($Q_2$).

Each of inorganic fine particles (B-a) to (B-i) in an amount of 0.50 g was weighed into a 50 ml-plastic bottle and left standing overnight (at least 12 hours) in an environment of normal temperature/normal humidity (23.5° C./60%RH) while the bottle was held open. Then, 9.50 g of Carrier (C) was charged in each bottle, and each bottle was tightly closed and subjected to shaking (ca. 220 times) by a shaker ("YS-LD", mfd. by K.K. Yayoi-sha) at a scale of 150 for 1 min.

Each measurement sample prepared in the above-described manner was subjected to measurement of triboelectric charge in the above-described manner similarly as the toner charge measurement. (Regarding the triboelectric charge-imparting performance of inorganic fine powder (B), a positively larger value represents a better performance.) The results are shown in Table 2 above.

For measurement of charge ($Q_1$) of inorganic fine powders (A-a) to (A-n), each powder sample in 0.2 g was weighed into a 50-ml plastic bottle and subjected to standing under the same conditions as above.

9.80 g of iron powder ("EFV 200/300", mfd. by Nippon Teppun K.K.) was added as a carrier into the bottle, and the bottle was closed, shaked and subjected to triboelectric charge measurement in the same manner as above. The results are shown in Table 1 above.

(Toner performance evaluation)

The above-prepared Magnetic toner (X-1) was charged in a copying machine obtained by re-modeling a commercially available copying machine including a contact-charging means and a contact-transfer means ("NP-6030", available from Canon K.K.) into a form of drum-heaterless having a process speed of 35 sheets/min and including a heat-fixing device shown in FIG. 4 as a fixing means and a reversal-development scheme), for evaluation of the following items [Evaluation 2–4].

[Evaluation 2]

200 g of Magnetic toner (X-1) was charged in a developing device and leftstanding overnight (for at least 12 hours) in a normal temperature/normal humidity environment (23° C./60%RH) and then tested for 1000 sheets of image formation, to measure an image density thereafter. The developing device was then taken out and left standing overnight (12 hours) in a high temperature/high humidity environment (30° C./80%RH). The developing device was returned to the normal temperature/normal humidity environment, followed immediately by 20 sheets of image formation to measure the image density similarly as in the previous day (mentioned above). The image density on the first sheet was compared with the image density on the last sheet (1000-th sheet), and the performance was evaluated based on the image density (ID) difference at the following levels.

| | |
|---|---|
| A: | ID difference ≦ 0.02. |
| B: | ID difference = 0.03–0.05. |
| C: | ID difference = 0.06–0.10. |
| D: | ID difference = 0.11–0.15. |
| E: | ID difference = 0.16–0.20. |
| F: | ID difference ≧ 0.21. |

[Evaluation 3]

200 g of Magnetic toner (X-1) was charged in a developing device including a developing sleeve and left standing for overnight (for at least 12 hours) in a low temperature/low humidity environment (15° C./50%RH). By using an external drive mechanism, the developing sleeve was rotated, and the coating state of the magnetic toner on the developing sleeve was observed for 10 min. from the start of the rotation. The evaluation was performed at the following levels.

A: The surface state on the sleeve was very uniform.

B: The surface state on the sleeve was uniform but accompanied with a ripple-like pattern only at a limited part.

C: The surface on the sleeve was locally accompanied with a ripple pattern.

D: A ripple pattern was observed on the entire surface on the sleeve.

E: A local unevenness was clearly observed due to growth of ripple pattern at the surface on the sleeve.

F: A surface unevenness was clearly observed over the entire surface on the sleeve.

[Evaluation 4]

200 g of Magnetic toner (X-1) was charged in a developing sleeve, and left standing overnight (for at least 12 hours) in a low temperature/low humidity environment (15° C./50%RH ). A density evaluation chart was used as an original for 2000 sheets of image formation. Fog on a solid white image was measured at the initial stage and on 500th, 1000th and 2000th sheets during the image formation. The reflectance of each solid white image thus obtained was measured by a reflectance meter ("REFLECTOMETER", available from Tokyo Denshoku K.K.) was compared with that of non-used paper to measure a fog was follows:

fog (%)=[reflectance of non-used paper]−[reflectance of solid white image].

The results were evaluated at the following levels.

A: fog<0.1%

B: 0.1%≦fog≦0.5%

C: 0.5%<fog≦1.0%

D: 1.0%<fog≦1.5%

E: 1.5%<fog≦2.0%

F: 2.0%<fog

[Evaluation 5]

400 g of Magnetic toner (X-1) was charged in a developing device and left standing overnight (for at least 12 hours) in a high temperature/high humidity environment (30° C./80%RH). The developing device was subjected to 25×104 sheets of continuous image formation, while repeating the toner replenishment, by using a remodeled commercially available digital copying machine ("GP30FA", available from Canon K.K.; a drum heaterless-form, including a heat-fixing device of FIG. 4 (as fixing means), a charging roller (as a primary charger), a transfer roller (as a transfer means) and a process speed of 35 sheets/min). During the continuous image formation, the occurrence of filming was checked at an interval of $5\times10^4$ sheets. After $25\times10^4$ sheets, the image formation was continued and, when a toner replenishment sign was indicated, the toner residual check sensor was sturned off so as to allow a further operation of the machine. Thereafter, OHP sheets were supplied to evaluate the dropout, and the toner filming on the drum was evaluated again. After further standing overnight (for at least 12 hours of the machine still containing the toner), a large number of 1 mm-wide lines extending in a direction perpendicular to the paper feed direction were formed on transfer paper sheets (Kangas paper) to evaluate the fixation scattering. The evaluation was performed at the following levels for the respective items.

Dropout

A: No dropout at all.

B: Several dropout proportions were observed but at a level of practically no problem.

C: Many dropout portions were observed at a practically problematic level.

D: Dropout occurred in all the characters and line images.

Filming on photosensitive drum

A: No filming at all during the continuous image formation.

B: One or two spots of filming occurred during the continuous image formation but disappeared.

C: After the continuous image formation, several spots of filming occurred but disappeared.

D: More than 10 spots of filming occurred.

E: Filming occurred over the entire surface.

Fixation scattering

A: No fixation scattering at all.

B: Fixation scattering occurred at several parts but at a level of practically no problem.

C: Fixation scattering occurred at a large number of parts and at a practically problematic level.

D: Conspicuous fixation scattering occurred at all the line images.

EXAMPLES 2–6 AND COMPARATIVE EXAMPLES 1–5

Magnetic toners (X-2) to (X-26) and Comparative Magnetic toners (Y-1) to (Y-5) were prepared in the same manner as in Example 1 except for using inorganic fine powders (A) and (B) shown in Table 3.

Each Magnetic toner thus prepared was evaluated in the same manner as in Example 1. The results are shown in Tables 4–6.

TABLE 3

| | Inorganic fine powder (A) | | Inorganic fine powder (B) | |
|---|---|---|---|---|
| Magnetic toner | Series | Amount (wt. parts) | Species | Fine powder (wt. parts) |
| X-1 | A-a | 1.0 | B-a | 3.0 |
| X-2 | A-b | 1.0 | B-a | 3.0 |
| X-3 | A-b | 1.0 | B-c | 3.0 |
| X-4 | A-b | 1.0 | B-d | 3.0 |
| X-5 | A-b | 1.0 | B-c | 3.0 |
| X-6 | A-b | 1.0 | B-f | 3.0 |
| X-7 | A-c | 1.0 | B-a | 3.0 |
| X-8 | A-d | 1.0 | B-a | 3.0 |
| X-9 | A-e | 1.0 | B-a | 3.0 |
| X-10 | A-f | 1.0 | B-a | 3.0 |
| X-11 | A-g | 1.0 | B-a | 3.0 |
| X-12 | A-h | 1.0 | B-a | 3.0 |
| X-13 | A-i | 1.0 | B-a | 3.0 |
| X-14 | A-j | 1.0 | B-a | 3.0 |
| X-15 | A-k | 1.0 | B-a | 3.0 |
| X-16 | A-l | 1.0 | B-a | 3.0 |
| X-17 | A-b | 1.0 | B-i | 3.0 |
| X-18 | A-b | 0.08 | B-a | 3.0 |
| X-19 | A-b | 0.4 | B-a | 3.0 |
| X-20 | A-b | 2.2 | B-a | 4.2 |
| X-21 | A-b | 2.8 | B-a | 4.5 |
| X-22 | A-b | 1.0 | B-a | 0.08 |
| X-23 | A-b | 1.0 | B-a | 1.0 |
| X-24 | A-b | 1.0 | B-a | 9.0 |
| X-25 | A-b | 1.0 | B-a | 13 |
| X-26 | A-m | 1.0 | B-a | 3.0 |
| Y-1 | A-n | 1.0 | B-a | 3.0 |
| Y-2 | A-b | 0.8 | B-a | — |
| Y-3 | A-b | 1.0 | B-h | 3.0 |
| Y-4 | A-b | 1.0 | B-b | 3.0 |
| Y-5 | A-b | 1.0 | B-g | 3.0 |

TABLE 4

| | Magnetic | Evaluation 2 (NT/NH - HT/HH standing) | | | | | | Evaluation 4 (Fog in LT/LH) | | | | |
|---|---|---|---|---|---|---|---|---|---|---|---|---|
| | toner | Initial | 500th | 1000th | after standing | Difference | Rank | Initial | 500th | 1000th | 2000th | Remarks |
| Ex. | | | | | | | | | | | | |
| 1 | X-1 | 1.50 | 1.49 | 1.48 | 1.44 | 0.04 | B | B | B | A | A | |
| 2 | X-2 | 1.51 | 1.52 | 1.53 | 1.51 | 0.02 | A | B | A | A | A | |

TABLE 4-continued

| | Magnetic toner | Evaluation 2 (NT/NH - HT/HH standing) Initial | 500th | 1000th | after standing | Difference | Rank | Evaluation 4 (Fog in LT/LH) Initial | 500th | 1000th | 2000th | Remarks |
|---|---|---|---|---|---|---|---|---|---|---|---|---|
| 3 | X-3 | 1.37 | 1.38 | 1.39 | 1.28 | 0.11 | D | B | A | A | A | |
| 4 | X-4 | 1.43 | 1.44 | 1.43 | 1.34 | 0.09 | C | B | A | A | A | |
| 5 | X-5 | 1.43 | 1.4 | 1.35 | 1.24 | 0.11 | D | C | C | B | B | *1 |
| 6 | X-6 | 1.39 | 1.37 | 1.34 | 1.23 | 0.11 | D | C | C | C | B | *1 |
| 7 | X-7 | 1.35 | 1.36 | 1.35 | 1.3 | 0.05 | B | B | B | A | A | |
| 8 | X-8 | 1.37 | 1.39 | 1.41 | 1.36 | 0.05 | B | B | B | A | A | |
| 9 | X-9 | 1.56 | 1.48 | 1.43 | 1.37 | 0.06 | C | B | A | A | B | |
| 10 | X-10 | 1.57 | 1.49 | 1.42 | 1.36 | 0.06 | C | B | A | A | B | |
| 11 | X-11 | 1.49 | 1.45 | 1.41 | 1.32 | 0.09 | C | B | A | B | B | |
| 12 | X-12 | 1.51 | 1.48 | 1.45 | 1.37 | 0.08 | C | B | A | B | B | |
| 13 | X-13 | 1.39 | 1.35 | 1.29 | 1.22 | 0.07 | C | D | D | C | C | |
| 14 | X-14 | 1.37 | 1.33 | 1.27 | 1.2 | 0.07 | C | D | D | C | C | |
| 15 | X-15 | 1.47 | 1.17 | 1.47 | 1.4 | 0.07 | C | B | B | A | A | |
| 16 | X-16 | 1.46 | 1.44 | 1.43 | 1.36 | 0.07 | C | B | B | A | A | |
| 17 | X-17 | 1.47 | 1.46 | 1.43 | 1.33 | 0.1 | C | B | B | A | A | |
| 18 | X-18 | 1.24 | 1.22 | 1.22 | 1.1 | 0.12 | D | D | D | D | D | |
| 19 | X-19 | 1.3 | 1.29 | 1.31 | 1.2 | 0.11 | D | D | D | D | D | |
| 20 | X-20 | 1.55 | 1.52 | 1.48 | 1.43 | 0.05 | B | B | A | B | B | |
| 21 | X-21 | 1.57 | 1.54 | 1.5 | 1.44 | 0.06 | B | B | A | B | B | |
| 22 | X-22 | 1.46 | 1.46 | 1.44 | 1.31 | 0.13 | D | B | A | A | A | |
| 23 | X-23 | 1.47 | 1.47 | 1.47 | 1.4 | 0.07 | C | B | A | A | A | |
| 24 | X-24 | 1.48 | 1.49 | 1.49 | 1.48 | 0.01 | A | D | D | D | B | |
| 25 | X-25 | 1.49 | 1.49 | 1.49 | 1.47 | 0.02 | A | D | D | D | D | |
| 26 | X-26 | 1.32 | 1.32 | 1.31 | 1.2 | 0.11 | D | A | A | A | A | |
| Comp. Ex. | | | | | | | | | | | | |
| 1 | Y-1 | 1.32 | 1.31 | 1.31 | 1.17 | 0.14 | D | A | B | B | B | |
| 2 | Y-2 | 1.4 | 1.39 | 1.4 | 1.19 | 0.21 | F | A | A | A | A | |
| 3 | Y-3 | 1.43 | 1.43 | 1.42 | 1.26 | 0.16 | E | B | A | A | A | |
| 4 | Y-4 | 1.41 | 1.4 | 1.39 | 1.2 | 0.19 | E | B | A | A | A | |
| 5 | Y-5 | 1.33 | 1.24 | 1.22 | 1.1 | 0.12 | D | E | E | D | D | *2 |

*1: Slight toner scattering observed.
*2: Much toner scattering observed.

TABLE 5

| | Magnetic toner | Toner coating on developing sleeve in LT/LH Evaluation 3 30 sec. | 1 min. | 3 min. | 5 min. | 10 min. |
|---|---|---|---|---|---|---|
| Ex. 1 | X-1 | A | A | A | A | A |
| Ex. 2 | X-2 | A | A | A | A | A |
| Ex. 3 | X-3 | A | A | A | A | A |
| Ex. 4 | X-4 | A | A | A | A | A |
| Ex. 5 | X-5 | A | A | A | A | A |
| Ex. 6 | X-6 | B | B | B | A | A |
| Ex. 7 | X-7 | A | A | A | A | A |
| Ex. 8 | X-8 | A | A | A | A | A |
| Ex. 9 | X-9 | C | C | B | B | B |
| Ex. 10 | X-10 | C | C | B | B | B |
| Ex. 11 | X-11 | A | A | A | A | A |
| Ex. 12 | X-12 | A | A | A | A | A |
| Ex. 13 | X-13 | D | D | C | C | C |
| Ex. 14 | X-14 | D | D | D | D | D |
| Ex. 15 | X-15 | A | A | A | A | A |
| Ex. 16 | X-16 | A | A | A | A | A |
| Ex. 17 | X-17 | A | A | A | A | A |
| Ex. 18 | X-18 | D | D | B | B | B |
| Ex. 19 | X-19 | B | B | B | B | B |
| Ex. 20 | X-20 | D | D | D | D | C |
| Ex. 21 | X-21 | D | D | D | D | D |
| Ex. 22 | X-22 | D | D | D | D | D |
| Ex. 23 | X-23 | C | C | C | C | C |
| Ex. 24 | X-24 | A | A | A | A | A |
| Ex. 25 | X-25 | A | A | A | A | A |
| Ex. 26 | X-26 | A | A | A | A | A |

TABLE 5-continued

| | Magnetic toner | Toner coating on developing sleeve in LT/LH Evaluation 3 30 sec. | 1 min. | 3 min. | 5 min. | 10 min. |
|---|---|---|---|---|---|---|
| Comp. Ex. | | | | | | |
| 1 | Y-1 | A | A | A | A | A |
| 2 | Y-2 | F | F | F | F | F |
| 3 | Y-3 | E | E | E | D | D |
| 4 | Y-4 | A | A | A | A | A |
| 5 | Y-5 | C | C | A | A | A |

TABLE 6

| | | Evaluation 5 (in HT/HH) | | | | | | |
|---|---|---|---|---|---|---|---|---|
| | | Filming | | | | | | |
| | Magnetic toner | $5 \times 10^4$ sheets | $10 \times 10^5$ sheets | $15 \times 10^5$ sheets | $20 \times 10^5$ sheets | $25 \times 10^5$ sheets | Dropout | Fixation scattering |
| Ex. | | | | | | | | |
| 1 | X-1 | A | A | A | A | A | A | A |
| 2 | X-2 | A | A | A | A | A | A | A |
| 3 | X-3 | A | A | A | B | B | B | C |
| 4 | X-4 | A | A | A | A | B | B | B |
| 5 | X-5 | A | A | A | A | A | A | A |
| 6 | X-6 | A | A | A | A | A | A | A |
| 7 | X-7 | A | A | A | A | B | B | B |
| 8 | X-8 | A | A | A | A | A | B | B |
| 9 | X-9 | A | A | A | A | A | A | A |
| 10 | X-10 | A | A | A | A | A | A | A |
| 11 | X-11 | A | B | C | C | C | C | B |
| 12 | X-12 | A | A | B | B | B | C | B |
| 13 | X-13 | A | A | A | A | A | A | B |
| 14 | X-14 | A | A | A | A | A | A | B |
| 15 | X-15 | A | A | A | A | A | A | B |
| 16 | X-16 | A | A | A | A | A | B | B |
| 17 | X-17 | A | A | A | A | A | B | B |
| 18 | X-18 | A | A | A | A | A | C | C |
| 19 | X-19 | A | A | A | A | A | C | B |
| 20 | X-20 | A | A | A | B | C | A | A |
| 21 | X-21 | A | A | B | C | D | A | A |
| 22 | X-22 | A | A | B | C | C | B | C |
| 23 | X-23 | A | A | A | A | A | A | A |
| 24 | X-24 | A | A | A | A | A | A | A |
| 25 | X-25 | A | A | A | A | A | A | A |
| 26 | X-26 | A | A | A | A | A | A | A |
| Comp. Ex. | | | | | | | | |
| 1 | Y-1 | A | B | C | C | D | E | C |
| 2 | Y-2 | A | B | C | D | E | A | D |
| 3 | Y-3 | A | B | C | C | C | A | C |
| 4 | Y-4 | A | A | A | A | A | A | D |
| 5 | Y-5 | A | A | A | A | C | A | D |

What is claimed is:

1. A toner for developing an electrostatic image comprising: toner particles containing at least a binder resin and a colorant, and inorganic fine powder; wherein the inorganic fine powder includes:

(A) inorganic fine powder (A) treated at least with silicone oil, and (B) inorganic fine powder (B) comprising a composite metal oxide containing Sr and Si as constituent elements, and having a weight-average particle size of 0.3–5 μm, wherein the composite metal oxide comprises strontium silicate represented by $Sr_a\ Si_b\ o_c$, wherein a denotes an integer of 1–9, b denotes an integer of 1–9 and c denotes an integer of 3–9.

2. The toner according to claim 1, wherein the inorganic fine powder (A) has been treated with a silane coupling agent prior to or simultaneously with the treatment with silicone oil.

3. The toner according to claim 1, wherein the inorganic fine powder (A) has a specific surface area of 50–400 $m^2/g$ and a hydrophobicity of at least 95%.

4. The toner according to claim 1, wherein the silicone oil for providing the inorganic fine powder (A) has a viscosity at 25° C. of 5–2000 $mm^2/sec$.

5. The toner according to claim 1, wherein the inorganic fine powder (A) has been obtained by treating 100 wt. parts of inorganic fine powder with 1.5–60 parts of silicone oil.

6. The toner according to claim 1, wherein the inorganic fine powder (A) has a charging polarity identical to that of the toner particles and has a charge Q1 satisfying |Q11|>150 (mC/kg) when triboelectrified with iron powder, and the inorganic fine powder (B) has a charging polarity opposite to that of the toner particles and has a charge Q1 satisfying |Q2|>3.7 (mC/kg) when triboelectrified with the toner particles.

7. The toner according to claim 1, wherein the inorganic fine powder (A) comprises a member selected from the group consisting of titania, alumina and silica.

8. The toner according to claim 1, wherein the inorganic fine powder (A) is contained in 0.05–3 wt. parts per 100 wt. parts of the toner particles.

9. The toner according to claim 1, wherein the inorganic fine powder (B) is contained in 0.05–15 wt. parts per 100 wt. parts of the toner particles.

10. The toner according to claim 1, wherein the inorganic fine powder (B) has a weight-average particle size of 0.5–3 μm.

11. The toner according to claim 1, wherein the composite metal oxide contains the metal Sr and Si in a ratio (a/b) of 1/9–9.0.

12. The toner according to claim 1, wherein the composite metal oxide contains the metal Sr and Si in a ratio (a/b) of 0.5–3.0.

13. The toner according to claim 1, wherein the composite metal oxide comprises a strontium silicate selected from the group consisting of $SrSiO_3$, $Sr_3SiO_5$, $Sr_2SiO_4$ and $Sr_3Si_2O_7$.

14. The toner according to claim 1, wherein the composite metal oxide comprises $SrSiO_3$.

15. The toner according to claim 1, wherein the toner particles have a negative triboelectric chargeability relative to iron powder.

16. The toner according to claim 1, wherein the toner particles have a weight-average particle size of 5.5–12 μm.

17. The toner according to claim 1, wherein the toner particles have a weight-average particle size of 5.5–9 μm.

18. An image forming method, comprising:

charging an electrostatic image-bearing member by primary charging means:

forming an electrostatic image on the charged electrostatic image-bearing member by exposure to light;

developing the electrostatic image with a toner held developing means to form a toner image on the electrostatic image-bearing member;

transferring the toner image on the electrostatic image-bearing member by transfer means onto a transfer-receiving material via or without via an intermediate transfer member, heat-fixing the toner image on the transfer-receiving material by heat-fixing means;

wherein the toner comprises: toner particles containing at least a binder resin and a colorant, and inorganic fine powder; wherein the inorganic fine powder includes:

(A) inorganic fine powder (A) treated at least with silicone oil, and (B) inorganic fine powder (B) comprising a composite metal oxide containing Sr and Si as constituent elements, and having a weight-average particle size of 0.3–5 μm, wherein the composite metal oxide comprises strontium silicate represented by $Sr_a S_b O_c$, wherein a denotes an integer of 1–9, b denotes an integer of 1–9 and c denotes an integer of 3–9.

19. The image forming method according to claim 18, wherein the electrostatic image-bearing member is charged by a contact-charging member as the primary charging means abutted against the electrostatic image-bearing member.

20. The image forming method according to claim 18, wherein the toner image on the electrostatic image-bearing member is transferred onto a transfer-receiving material by a contact-transfer member as the transfer means abutted against the electrostatic image-bearing member via the transfer-receiving material.

21. The image forming method according to claim 18, wherein the toner image is heat-fixed onto the transfer-receiving material by a heat-fixing device as the heat-fixing means comprising a heating member, a film disposed along the heating member and a pressing member disposed opposite to and pressed against the heating member via the film so as to press the transfer-receiving material intimately against the heating member via the film.

22. The image forming method according to claim 18, wherein the electrostatic image-bearing member is charged by a contact-charging member as the primary charging means abutted against the electrostatic image-bearing member; and the toner image on the electrostatic image-bearing member is transferred onto a transfer-receiving material by a contact-transfer member as the transfer means abutted against the electrostatic image-bearing member via the transfer-receiving material.

23. The image forming method according to claim 18, wherein the electrostatic image-bearing member is charged by a contact-charging member as the primary charging means abutted against the electrostatic image-bearing member:

the toner image on the electrostatic image-bearing member is transferred onto a transfer-receiving material by a contact-transfer member as the transfer means abutted against the electrostatic image-bearing member via the transfer-receiving material; and the toner image is heat-fixed onto the transfer-receiving material by a heat-fixing device as the heat-fixing means comprising a heating member, a film disposed along the heating member and a pressing member disposed opposite to and pressed against the heating member via the film so as to press the transfer-receiving material intimately against the heating member via the film.

24. The image forming method according to claim 18, wherein the inorganic fine powder (A) has been treated with a silane coupling agent prior to or simultaneously with the treatment with silicone oil.

25. The image forming method according to claim 18, wherein the inorganic fine powder (A) has a specific surface area of 50–400 $m^2/g$ and a hydrophobicity of at least 95%.

26. The image forming method according to claim 18, wherein the silicone oil for providing the inorganic fine powder (A) has a viscosity at 25° C. of 5–2000 $mm^2/sec$.

27. The image forming method according to claim 18, wherein the inorganic fine powder (A) has been obtained by treating 100 wt. parts of inorganic fine powder with 1.5–60 parts of silicone oil.

28. The image forming method according to claim 18, wherein the inorganic fine powder (A) has a charging polarity identical to that of the toner particles and has a charge Q1 satisfying $|Q11|>150$ (mC/kg) when triboelectrified with iron powder, and the inorganic fine powder (B) has a charging polarity opposite to that of the toner particles and has a charge Q1 satisfying $|Q2|>3.7$ (mC/kg) when triboelectrified with the toner particles.

29. The image forming method according to claim 18, wherein the inorganic fine powder (A) comprises a member selected from the group consisting of titania, alumina and silica.

30. The image forming method according to claim 21, wherein the inorganic fine powder (A) is contained in 0.05–3 wt. parts per 100 wt. parts of the toner particles.

31. The image forming method according to claim 18, wherein the inorganic fine powder (B) is contained in 0.05–15 wt. parts per 100 wt. parts of the toner particles.

32. The image forming method according to claim 18, wherein the inorganic fine powder (B) has a weight-average particle size of 0.5–3 μm.

33. The image forming method according to claim 18, wherein the composite metal oxide contains the Sr and Si in a ratio (a/b) of ⅙–9.0.

34. The image forming method according to claim 18, wherein the composite metal oxide contains the metal M and Si in a ratio (a/b) of 0.5–3.0.

35. The image forming method according to claim 18, wherein the composite metal oxide comprises a strontium silicate selected from the group consisting of $SrSiO_3$, $Sr_3SiO_5$, $Sr_2SiO_4$ and $Sr_3Si_2O_7$.

36. The image forming method according to claim 18, wherein the composite metal oxide comprises $SrSiO_3$.

37. The image forming method according to claim 18, wherein the toner particles have a negative triboelectric chargeability relative to iron powder.

38. The image forming method according to claim 18, wherein the toner particles have a weight-average particle size of 5.5–12 μm.

39. The image forming method according to claim 18, wherein the toner particles have a weight-average particle size of 5.5–9 μm.

40. A process cartridge, comprising:

an electrostatic image-bearing member, and developing means for developing an electrostatic image formed on the electrostatic image-bearing member with a toner contained therein; the electrostatic image-bearing member and the developing means being integrally assembled to form a cartridge, which is detachably mountable to a main assembly of the image forming apparatus;

wherein the toner comprises: toner particles containing at least a binder resin and a colorant, and inorganic rind powder; wherein the inorganic fine powder includes:

(A) inorganic fine powder (A) treated at least with silicone oil, and (B) inorganic fine powder (B) comprising a composite metal oxide containing Sr and Si as constituent elements, and having a weight-average particle size of 0.3–5 μm, wherein the composite metal oxide comprise, strontium silicate represented by $Sr_a Si_b O_c$, wherein a denotes an integer of 1–9, b denotes an integer of 1–9 and c denotes an integer of 3–9.

41. The process-cartridge according to claim 40, further comprising a contact-charging member abutted against the electrostatic image-bearing member to charge the electrostatic image-bearing member.

42. The process-cartridge according to claim 32, further comprising a cleaning member abutted against the electrostatic image-bearing member to clear the electrostatic image-bearing member.

43. The process-cartridge according to claim 40, further comprising:

a contact-charging member abutted against the electrostatic image-bearing member to charge the electrostatic image-bearing member;

a cleaning member abutted against the electrostatic image-bearing member to clear the electrostatic image-bearing member.

44. The process-cartridge according to claim 40, wherein the inorganic fine powder (A) has been treated with a silane coupling agent prior to or simultaneously with the treatment with silicone oil.

45. The process-cartridge according to claim 40, wherein the inorganic fine powder (A) has a specific surface area of 50–400 $m^2/g$ and a hydrophobicity of at least 95%.

46. The process-cartridge according to claim 40, wherein the silicone oil for providing the inorganic fine powder (A) has a viscosity at 25° C. of 5–2000 $mm^2/sec$.

47. The process-cartridge according to claim 40, wherein the inorganic fine powder (A) has been obtained by treating 100 wt. parts of inorganic fine powder with 1.5–60 parts of silicone oil.

48. The process-cartridge according to claim 40, wherein the inorganic fine powder (A) has a charging polarity identical to that of the toner particles and has a charge Q1 satisfying $|Q11|>150$ (mC/kg) when triboelectrified with iron powder, and the inorganic fine powder (B) has a charging polarity opposite to that of the toner particles and has a charge Q1 satisfying $|Q2|>3.7$ (mC/kg) when triboelectrified with the toner particles.

49. The process-cartridge according to claim 40, wherein the inorganic fine powder (A) comprises a member selected from the group consisting of titania, alumina and silica.

50. The process-cartridge according to claim 40, wherein the inorganic fine powder (A) is contained in 0.05–3 wt. parts per 100 wt. parts of the toner particles.

51. The process-cartridge according to claim 40, wherein the inorganic fine powder (B) is contained in 0.05–15 wt. parts per 100 wt. parts of the toner particles.

52. The process-cartridge according to claim 40, wherein the inorganic fine powder (B) has a weight-average particle size of 0.5–3 μm.

53. The process-cartridge according to claim 40, wherein the composite metal oxide contains the Sr and Si in a ratio (a/b) of ⅙–9.0.

54. The process-cartridge according to claim 40, wherein the composite metal oxide contains the Sr and Si in a ratio (a/b) of 0.5–3.0.

55. The process-cartridge according to claim 40, wherein the composite metal oxide comprises a strontium silicate selected from the group consisting of $SrSiO_3$, $Sr_3SiO_5$, $Sr_2SiO_4$ and $Sr_3Si_2O_7$.

56. The process-cartridge according to claim 40, wherein the composite metal oxide comprises $SrSiO_3$.

57. The process-cartridge according to claim 40, wherein the toner particles have a negative triboelectric chargeability relative to iron powder.

58. The process-cartridge according to claim 40, wherein the toner particles have a weight-average particle size of 5.5–12 μm.

59. The process-cartridge according to claim 40, wherein the toner particles have a weight-average particle size of 5.5–9 μm.

* * * * *

UNITED STATES PATENT AND TRADEMARK OFFICE

CERTIFICATE OF CORRECTION

PATENT NO. : 5,695,902

DATED : December 9, 1997

INVENTOR(S): MIKURIYA ET AL.

It is certified that error appears in the above-identified patent and that said Letters Patent is hereby corrected as shown below:

COLUMN 1

Line 20, "after" should read --after being--;
Line 26, "having" should read --having a--.

COLUMN 2

Line 66, "cause" should read --causes--.

COLUMN 3

Line 7, "the" should be deleted;
Line 36, "melt sticking" should read --melt-sticking--;
Line 42, "are" should read --is--.

COLUMN 4

Line 4, "of" should read --of the--;
Line 8, "melt sticking)" should read --melt-sticking)--;
Line 16, "is" should read --is not--; delete "not";
Line 30, "higher copying speed" should read --higher speed copying--;
Line 32, "because," should read --because--.

COLUMN 5

Line 17, "In" should read --In the--;
Line 48, "is" should read --are--.

UNITED STATES PATENT AND TRADEMARK OFFICE

CERTIFICATE OF CORRECTION

PATENT NO. : 5,695,902

DATED : December 9, 1997

INVENTOR(S): MIKURIYA ET AL.

It is certified that error appears in the above-identified patent and that said Letters Patent is hereby corrected as shown below:

COLUMN 6

Line 3, "in" should read --in the--;
Line 22, "contact" should read --contacts----;
Line 38, "at an" should read --the--;
Line 64, "lack" should read --blank--.

COLUMN 7

Line 43, "without via" should read --without--.

COLUMN 8

Line 32, "addition" should read --additional--;
Line 46, "its" should read --their--;
Line 65, "fin" should read --fine--.

COLUMN 9

Line 6, "compltely" should read --completely--.

UNITED STATES PATENT AND TRADEMARK OFFICE

CERTIFICATE OF CORRECTION

PATENT NO. : 5,695,902

DATED : December 9, 1997

INVENTOR(S): MIKURIYA ET AL.

It is certified that error appears in the above-identified patent and that said Letters Patent is hereby corrected as shown below:

COLUMN 10

Line 17, "dimethylsilocone" should read --dimethylsilicone--;
Line 19, "silicone and." should read --silicone.--;
Line 40, "particle" should read --particles--;
Line 41, "with" should read --in--;
Line 50, "3.5'wt." should read --3.5-40 wt.--.

COLUMN 12

Line 59, "prevent the problems," should read --prevent problems--.

COLUMN 17

Line 43, "(as)" should read --(σs)--;
Line 57, "purpose," should read --purposes,--.

COLUMN 18

Line 56, "acides" should read --acids--.

COLUMN 19

Line 35, "0.5 wt., %," should read --0.5 wt. %,--.

UNITED STATES PATENT AND TRADEMARK OFFICE

CERTIFICATE OF CORRECTION

PATENT NO. : 5,695,902

DATED : December 9, 1997

INVENTOR(S): MIKURIYA ET AL.

It is certified that error appears in the above-identified patent and that said Letters Patent is hereby corrected as shown below:

COLUMN 20

Line 34, $cm^3$-tightly" should read --$cm^3$ tightly--;
Line 37, "shaked" should read --shaken--.

COLUMN 21

Line 51, "vinyl-the" should read --vinyl-type--.

COLUMN 23

Line 8, "0.1" should read --0.1%--;
Line 13, "/alcohol x N = 56.1/" should read --/alcohol x N x 56.1/--.
Line 65, "a a" should read --as a--.

COLUMN 25

Line 15, "100 μm" should read --100 μm,--.

COLUMN 26

Line 40, "assemble" should read --assembled--.

UNITED STATES PATENT AND TRADEMARK OFFICE

CERTIFICATE OF CORRECTION

PATENT NO. : 5,695,902

DATED : December 9, 1997

INVENTOR(S): MIKURIYA ET AL.

It is certified that error appears in the above-identified patent and that said Letters Patent is hereby corrected as shown below:

COLUMN 28

Line 2, "vaporize" should read --vaporized--;
Line 5, "all" should read --were all--.

COLUMN 29

Line 46, "of" should read --of the--;
Line 63, "in" should read --of--.

COLUMN 30

Line 1, "shaked" should read --shaken--;
Line 9, "drum-heaterless" should read --non-heated drum--;
Line 16, "leftstanding" should read --left standing--;
Line 54, "on" should read --of--.

COLUMN 31

Line 4, "was" should read --as--;
Line 21, "25 x 104" should read --25 x $10^4$--;
Line 24, "drum-heaterless" should read --non-heated drum--;
Line 32, "sturned" should read --turned--.

UNITED STATES PATENT AND TRADEMARK OFFICE

CERTIFICATE OF CORRECTION

PATENT NO. : 5,695,902

DATED : December 9, 1997

INVENTOR(S): MIKURIYA ET AL.

It is certified that error appears in the above-identified patent and that said Letters Patent is hereby corrected as shown below:

COLUMN 35

Line 52, "$o_c$," should read --$O_c$,--;
Line 67, "1.5-60" should read --1.5-60 wt.--.

COLUMN 36

Line 60, "the metal Sr" should read --the Sr--;
Line 63, "the metal Sr" should read --the Sr--.

COLUMN 37

Line 11, "means:" should read --means;--;
Line 19, "without via" should read --without--;
Line 20, "member," should read --member;--;
Line 33, "$S_b$" should read --$Si_b$--.

COLUMN 38

Line 4, "member:" should read --member;--;
Line 29, "1.5-60" should read --1.5-60 wt.--.

UNITED STATES PATENT AND TRADEMARK OFFICE

CERTIFICATE OF CORRECTION

PATENT NO. : 5,695,902

DATED : December 9, 1997

INVENTOR(S): MIKURIYA ET AL.

It is certified that error appears in the above-identified patent and that said Letters Patent is hereby corrected as shown below:

COLUMN 39

Line 17, "rind" should read --fine--;
Line 25, "comprise," should read --comprises--.

COLUMN 40

Line 6, "1.5-60" should read --1.5-60 wt.--.

Signed and Sealed this

Twenty-first Day of July, 1998

Bruce Lehman

*Attest:*

BRUCE LEHMAN

*Attesting Officer*

*Commissioner of Patents and Trademarks*